US011897078B2

(12) United States Patent
Nakamura et al.

(10) Patent No.: US 11,897,078 B2
(45) Date of Patent: Feb. 13, 2024

(54) POLISHING APPARATUS, INFORMATION PROCESSING SYSTEM, POLISHING METHOD, AND COMPUTER-READABLE STORAGE MEDIUM

(71) Applicant: EBARA CORPORATION, Tokyo (JP)

(72) Inventors: Akira Nakamura, Tokyo (JP); Tsuneo Torikoshi, Tokyo (JP); Yuta Suzuki, Tokyo (JP); Hisanori Matsuo, Tokyo (JP); Takahito Kagoshima, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 261 days.

(21) Appl. No.: 17/205,344

(22) Filed: Mar. 18, 2021

(65) Prior Publication Data

US 2021/0291312 A1 Sep. 23, 2021

(30) Foreign Application Priority Data

Mar. 19, 2020 (JP) ..... 2020-048666

(51) Int. Cl.
*B24B 37/005* (2012.01)

(52) U.S. Cl.
CPC ..... *B24B 37/005* (2013.01)

(58) Field of Classification Search
CPC ..... B24B 37/005; B24B 49/02; B24B 49/03; B24B 49/04; B24B 49/10; B24B 49/12;
(Continued)

(56) References Cited

U.S. PATENT DOCUMENTS 9,687,955 B2 * 6/2017 Watanabe ..... B24B 37/005
2018/0093360 A1 * 4/2018 Shinozaki ..... B24B 49/10
(Continued)

FOREIGN PATENT DOCUMENTS

JP 2000-343380 A 12/2000
JP 2009-004442 A 1/2009
(Continued)

OTHER PUBLICATIONS

Ke et al.; "LightGBM: A Highly Efficient Gradient Boosting Decision Tree"; 31st Conf. on Neural Information Processing Systems; 2017; 9 pages.

*Primary Examiner* — Don M Anderson
*Assistant Examiner* — Caleb Andrew Holizna
(74) *Attorney, Agent, or Firm* — BakerHostetler

(57) ABSTRACT

A polishing apparatus that is capable of referring to a storage in which a machine learning model is stored, the machine learning model being learned using learning data in which a feature amount of a signal regarding a frictional force between a polishing member and a substrate in polishing or a feature amount of a temperature of the polishing member or the substrate in polishing is input, and data regarding a film thickness of the polished substrate or a parameter related to yield of a product included in the polished substrate is output, the device including: a polishing table provided with the polishing member and configured to be rotatable; a polishing head facing the polishing table and configured to be rotatable, wherein the substrate is attachable to a surface facing the polishing table; a control unit configured to perform control to polish the substrate by pressing the substrate against the polishing member while rotating the polishing table and the polishing head having the substrate attached thereto; and a processor configured to generate the feature amount from the signal regarding the frictional force between the polishing member and the substrate in polishing or the feature amount from the temperature of the polishing member or a target substrate in polishing, and output the data regarding the film thickness of the polished substrate or any of the parameters related to the yield of the product included in the polished substrate, as an estimated value, by inputting the generated feature amount to the learned machine learning model.

12 Claims, 17 Drawing Sheets

(58) Field of Classification Search
CPC ..... B24B 49/14; B24B 49/16; B24B 49/18; B24B 49/183; B24B 7/228; B24B 37/04; B24B 37/042; B24B 37/07; B24B 37/10; B24B 37/105; B24B 53/017
USPC ..... 451/5
See application file for complete search history.

(56) References Cited

U.S. PATENT DOCUMENTS

| | | | |
|---|---|---|---|
| 2019/0240799 | A1 | 8/2019 | Takeda et al. |
| 2019/0286111 | A1* | 9/2019 | Yennie ..... H01L 21/67253 |
| 2020/0016720 | A1 | 1/2020 | Nakamura |
| 2020/0023490 | A1 | 1/2020 | Nakanishi et al. |
| 2021/0370461 | A1 | 12/2021 | Kamiki et al. |

FOREIGN PATENT DOCUMENTS

| | | | |
|---|---|---|---|
| JP | 2016-006856 | A | 1/2016 |
| JP | 2018-058197 | A | 4/2018 |
| JP | 2019-193970 | A | 11/2019 |
| JP | 2020-011315 | A | 1/2020 |
| JP | 2020-013918 | A | 1/2020 |
| WO | WO 2018/074091 | A1 | 4/2018 |

* cited by examiner

POLISHING APPARATUS, INFORMATION PROCESSING SYSTEM, POLISHING METHOD, AND COMPUTER-READABLE STORAGE MEDIUM

BACKGROUND

Technical Field

The present technology relates to a polishing apparatus, an information processing system, a polishing method, and a computer-readable storage medium.

Related Art

Polishing apparatuses that polish substrates (for example, wafers) are known. For example, Patent Document 1 discloses, for example, that a polishing apparatus includes a polishing table provided with a polishing member and configured to be rotatable, and a polishing head facing the polishing table and configured to be rotatable, wherein a substrate is attachable to the surface facing the polishing table.

In the polishing apparatus, the polishing condition may deteriorate. Here, regarding the deterioration of the condition, a consumable member of the polishing apparatus (for example, polishing pad as an example of the polishing member) may be consumed, resulting in the deterioration of the table condition. When the polishing condition deteriorates as described above, the profile of the film thickness after polishing of the substrate (also referred to as a residual film) deteriorates (for example, the variation in film thickness becomes large). In such a case, in order to check whether the product is defective or not, a film thickness measuring device measures the film thickness or the film thickness profile after polishing for all polished substrates. Thus, a lot of man-hours are required. In particular, when only one film thickness measuring device is provided for a plurality of polishing apparatuses, there is a problem that, if all the polished substrates are measured with the film thickness measuring device, a bottleneck in measurement time with the film thickness measuring device occurs, and thus the throughput is decreased. It is also practiced to extract only some substrates and measure the film thicknesses of the extracted substrates or to reduce the measurement time of the film thickness measuring device (ITM) by reducing the number of measurement points of a substrate. However, both methods have a possibility of missing defective products and have an influence on yield of the product. Thus, the above methods are not preferable.

The present technology has been made in view of the above problems, and it is desired to provide a polishing apparatus, an information processing system, and a program capable of improving the throughput or yield without missing defective products.

A polishing apparatus according to one embodiment, the polishing apparatus that is capable of referring to a storage in which a machine learning model is stored, the machine learning model being learned using learning data in which a feature amount of a signal regarding a frictional force between a polishing member and a substrate in polishing or a feature amount of a temperature of the polishing member or the substrate in polishing is input, and data regarding a film thickness of the polished substrate or a parameter related to yield of a product included in the polished substrate is output, the device comprising:

a polishing table provided with the polishing member and configured to be rotatable;

a polishing head facing the polishing table and configured to be rotatable, wherein the substrate is attachable to a surface facing the polishing table;

a control unit configured to perform control to polish the substrate by pressing the substrate against the polishing member while rotating the polishing table and the polishing head having the substrate attached thereto; and a processor configured to generate the feature amount from the signal regarding the frictional force between the polishing member and the substrate in polishing or the feature amount from the temperature of the polishing member or a target substrate in polishing, and output the data regarding the film thickness of the polished substrate or any of the parameters related to the yield of the product included in the polished substrate, as an estimated value, by inputting the generated feature amount to the learned machine learning model.

An information processing system according to one embodiment, the information processing system that is capable of referring to a storage in which a machine learning model is stored, the machine learning model being learned using learning data in which a feature amount of a signal regarding a frictional force between a polishing member and a substrate in polishing or a feature amount of a temperature of the polishing member or the substrate in polishing is input, and data regarding a film thickness of the polished substrate or a parameter related to yield of a product included in the polished substrate is output, the system comprising:

a generation unit configured to generate the feature amount from the signal regarding the frictional force between the polishing member and the substrate in polishing or the feature amount from the temperature of the polishing member or a target substrate in polishing; and an estimation unit configured to output the data regarding the film thickness of the polished substrate or any of the parameters related to the yield of the product included in the polished substrate, as an estimated value, by inputting the generated feature amount to the learned machine learning model.

A polishing method according to one embodiment, the polishing method for polishing a substrate by a polishing apparatus that is capable of referring to a storage in which a machine learning model is stored, the machine learning model being learned using learning data in which a feature amount of a signal regarding a frictional force between a polishing member and a substrate in polishing or a feature amount of a temperature of the polishing member or the substrate in polishing is input, and data regarding a film thickness of the polished substrate or a parameter related to yield of a product included in the polished substrate is output, the method comprising:

polishing the substrate by pressing the substrate against the polishing member while rotating the polishing table and the polishing head having the substrate attached thereto;

generating the feature amount by measuring the signal regarding the frictional force between the polishing member and the substrate in polishing or the temperature of the polishing member or a target substrate in polishing;

inputting the generated feature amount to the learned machine learning model; and outputting the data regarding the film thickness of the polished substrate or any of the parameters related to the yield of the product included in the polished substrate, as an estimated value.

A computer-readable storage medium according to one embodiment, the computer-readable storage medium storing a program causing a computer that is capable of referring to a storage in which a machine learning model is stored, the machine learning model being learned using learning data in which a feature amount of a signal regarding a frictional force between a polishing member and a substrate in polishing or a feature amount of a temperature of the polishing member or the substrate in polishing is input, and data regarding a film thickness of the polished substrate or a parameter related to yield of a product included in the polished substrate is output, to function as:

a generation unit configured to generate the feature amount from the signal regarding the frictional force between the polishing member and the substrate in polishing or the feature amount from the temperature of the polishing member or a target substrate in polishing; and an estimation unit configured to output the data regarding the film thickness of the polished substrate or any of the parameters related to the yield of the product included in the polished substrate, as an estimated value, by inputting the generated feature amount to the learned machine learning model.

DETAILED DESCRIPTION

Figure 1:
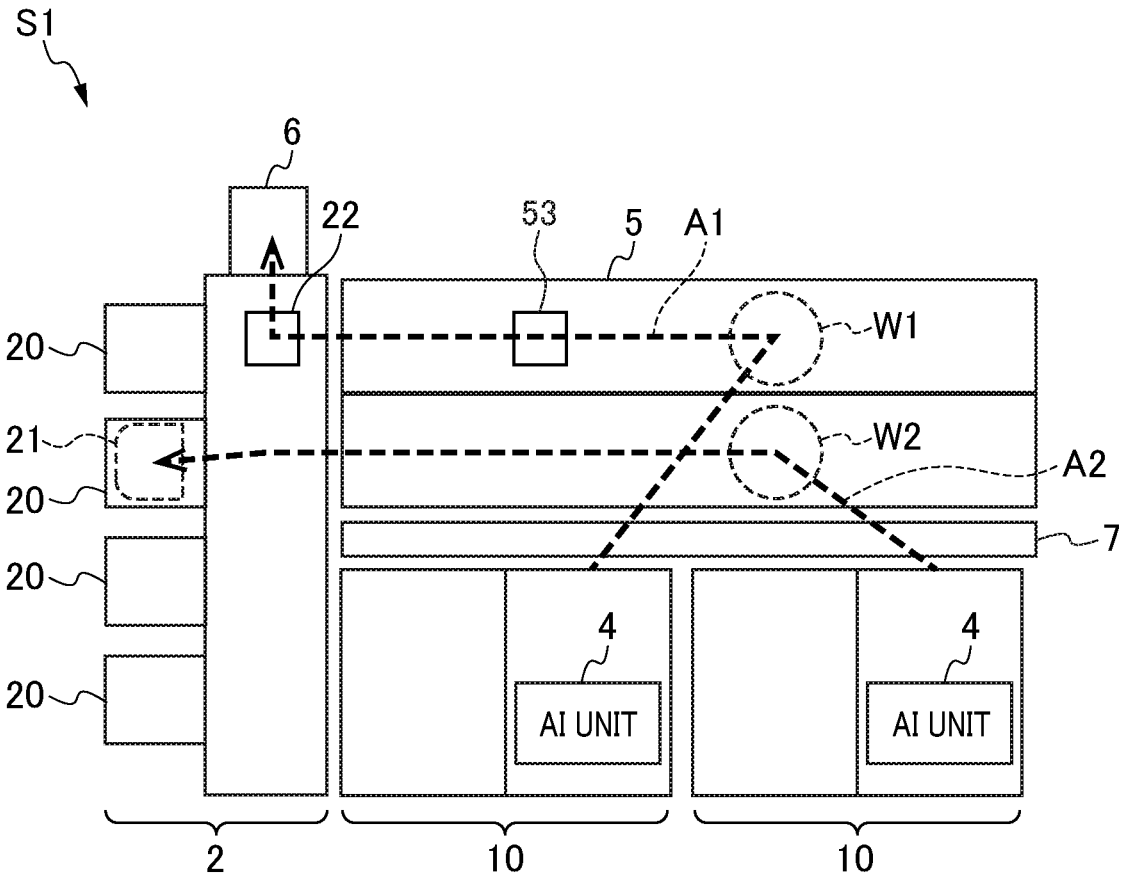
FIG. 1 is a schematic configuration diagram showing an information processing system according to a first embodiment.

Hereinafter, embodiments will be described with reference to the drawings. More detailed description than necessary may be omitted. For example, detailed description of already well-known matters and repetitive description for substantially the identical configuration may be omitted. This is to avoid unnecessary redundancy of the following description and to facilitate the understanding of those skilled in the art.

A polishing apparatus according to a 1st aspect of one embodiment, the polishing apparatus that is capable of referring to a storage in which a machine learning model is stored, the machine learning model being learned using learning data in which a feature amount of a signal regarding a frictional force between a polishing member and a substrate in polishing or a feature amount of a temperature of the polishing member or the substrate in polishing is input, and data regarding a film thickness of the polished substrate or a parameter related to yield of a product included in the polished substrate is output, the device comprises: a polishing table provided with the polishing member and configured to be rotatable; a polishing head facing the polishing table and configured to be rotatable, wherein the substrate is attachable to a surface facing the polishing table; a control unit configured to perform control to polish the substrate by pressing the substrate against the polishing member while rotating the polishing table and the polishing head having the substrate attached thereto; and a processor configured to generate the feature amount from the signal regarding the frictional force between the polishing member and the substrate in polishing or the feature amount from the temperature of the polishing member or a target substrate in polishing, and output the data regarding the film thickness of the polished substrate or any of the parameters related to the yield of the product included in the polished substrate, as an estimated value, by inputting the generated feature amount to the learned machine learning model.

According to this configuration, during polishing of a polishing apparatus, an estimated value of data regarding a film thickness of the polished substrate or an estimated value of a parameter related to the yield of a product included in the polished substrate is obtained. Thus, it is possible to predict the state of the substrate after polishing without measuring the film thickness. Thus, it is possible to recognize the state of the substrate after polishing without measuring the film thickness and to reduce the number of times of measuring the film thickness. Accordingly, it is possible to improve the throughput without missing a defective product. It is possible to improve the throughput by omitting the film thickness measurement in a case of normal polishing as described above. In addition, it is possible to detect or predict defects by estimating the parameter related to the yield. Further, it is possible to improve the yield by updating a polishing parameter in accordance with the parameter related to the yield.

A polishing apparatus according to a 2nd aspect of one embodiment, the polishing apparatus according to the 1st aspect, wherein the processor stops processing for a subsequent substrate when the output estimated value satisfies a predetermined polishing deterioration condition.

According to this configuration, when a polishing state deteriorates, processing for the subsequent substrate is stopped, so that it is possible to perform the maintenance such as replacement of the polishing member. Thus, it is possible to prevent the polishing state from further deterioration.

A polishing apparatus according to a 3rd aspect of one embodiment, the polishing apparatus according to the 1st aspect, further comprising a film thickness measuring device configured to measure the film thickness of the substrate, wherein the processor controls the film thickness measuring device to measure a film thickness of the polished target substrate when the output estimated value satisfies a predetermined polishing deterioration condition, and controls the film thickness measuring device not to measure the film thickness of the polished target substrate when the output estimated value does not satisfy the predetermined polishing deterioration condition.

According to this configuration, when the polishing state deteriorates, the film thickness of the substrate is measured, so that it is possible to determine whether or not the polishing is successful. In addition, when the polishing state does not deteriorate, the film thickness of the substrate is set not to be measured, and thus it is possible to improve the throughput.

A polishing apparatus according to a 4th aspect of one embodiment, the polishing apparatus according to the 1st aspect, wherein the processor outputs a maintenance timing by using a tendency of the estimated value output for the polished substrate at a plurality of different times.

According to this configuration, it is possible to predict a timing at which the polishing state deteriorates, and perform the maintenance such as replacement of the polishing member at this timing. Thus, it is possible to prevent the polishing state from further deterioration.

A polishing apparatus according to a 5th aspect of one embodiment, the polishing apparatus according to the first aspect, wherein the processor performs control to issue a warning for urging a maintenance, when the output estimated value satisfies a predetermined polishing deterioration condition.

According to this configuration, when the polishing state deteriorates, it is possible to perform the maintenance such as replacement of the polishing member, and thus to prevent the polishing state from further deterioration.

A polishing apparatus according to a 6th aspect of one embodiment, the polishing apparatus according to the 1 st aspect, wherein the processor adjusts a polishing condition for a subsequent substrate in accordance with the output estimated value so that data regarding a desired film thickness of a polished substrate or a parameter related to desired yield of a product included in the polished substrate is obtained.

According to this configuration, it is possible to change the polishing condition for the subsequent substrate so that the polishing state is improved. Thus, it is possible to maintain the favorable polishing state for a longer time.

A polishing apparatus according to a 7th aspect of one embodiment, the polishing apparatus according to the first aspect, wherein the processor learns the machine learning model again using the feature amount during an operation of the polishing apparatus.

According to this configuration, it is possible to improve the estimation accuracy.

An information processing system according to an 8th aspect of one embodiment, the information processing system that is capable of referring to a storage in which a machine learning model is stored, the machine learning model being learned using learning data in which a feature amount of a signal regarding a frictional force between a polishing member and a substrate in polishing or a feature amount of a temperature of the polishing member or the substrate in polishing is input, and data regarding a film thickness of the polished substrate or a parameter related to yield of a product included in the polished substrate is output, the system comprises: a generation unit configured to generate the feature amount from the signal regarding the frictional force between the polishing member and the substrate in polishing or the feature amount from the temperature of the polishing member or a target substrate in polishing; and an estimation unit configured to output the data regarding the film thickness of the polished substrate or any of the parameters related to the yield of the product included in the polished substrate, as an estimated value, by inputting the generated feature amount to the learned machine learning model.

According to this configuration, during polishing of a polishing apparatus, an estimated value of data regarding a film thickness of the polished substrate or an estimated value of a parameter related to the yield of a product included in the polished substrate is obtained. Thus, it is possible to predict the state of the substrate after polishing without measuring the film thickness. Thus, it is possible to recognize the state of the substrate after polishing without measuring the film thickness and to reduce the number of times of measuring the film thickness. Accordingly, it is possible to improve the throughput without missing a defective product.

A polishing method according to a 9th aspect of one embodiment, the polishing method for polishing a substrate by a polishing apparatus that is capable of referring to a storage in which a machine learning model is stored, the machine learning model being learned using learning data in which a feature amount of a signal regarding a frictional force between a polishing member and a substrate in polishing or a feature amount of a temperature of the polishing member or the substrate in polishing is input, and data regarding a film thickness of the polished substrate or a parameter related to yield of a product included in the polished substrate is output, the method comprising: polishing the substrate by pressing the substrate against the polishing member while rotating the polishing table and the polishing head having the substrate attached thereto; generating the feature amount by measuring the signal regarding the frictional force between the polishing member and the substrate in polishing or the temperature of the polishing member or a target substrate in polishing; inputting the generated feature amount to the learned machine learning model; and outputting the data regarding the film thickness of the polished substrate or any of the parameters related to the yield of the product included in the polished substrate, as an estimated value.

According to this configuration, during polishing of a polishing apparatus, an estimated value of data regarding a film thickness of the polished substrate or an estimated value of a parameter related to the yield of a product included in the polished substrate is obtained. Thus, it is possible to predict the state of the substrate after polishing without measuring the film thickness. Thus, it is possible to recognize the state of the substrate after polishing without measuring the film thickness and to reduce the number of times of measuring the film thickness. Accordingly, it is possible to improve the throughput without missing a defective product.

A computer-readable storage medium according to a 10th aspect of one embodiment, the computer-readable storage medium stores a program causing a computer that is capable of referring to a storage in which a machine learning model is stored, the machine learning model being learned using learning data in which a feature amount of a signal regarding a frictional force between a polishing member and a substrate in polishing or a feature amount of a temperature of the polishing member or the substrate in polishing is input, and data regarding a film thickness of the polished substrate or a parameter related to yield of a product included in the polished substrate is output, to function as: a generation unit configured to generate the feature amount from the signal regarding the frictional force between the polishing member and the substrate in polishing or the feature amount from the temperature of the polishing member or a target substrate in polishing; and an estimation unit configured to output the data regarding the film thickness of the polished substrate or any of the parameters related to the yield of the product included in the polished substrate, as an estimated value, by inputting the generated feature amount to the learned machine learning model.

In addition to the above-described problems, there is also a problem that it takes time to determine the deterioration of the polishing condition (for example, table condition).

In embodiments, the polishing state and the film thickness after polishing (also referred to as a residual film thickness), the statistical value (mean, maximum, minimum, and the like) of the film thickness, or the profile of the film thickness (also referred to as film thickness distribution) are determined from the change in a monitoring waveform during polishing. This makes it possible to estimate and manage favorable/defective polishing and the polishing condition (for example, table conditions) on time. Therefore, in the case of a defect, it is possible to adjust the table condition without performing the next polishing. Thus, it is possible to reduce the number of defectively polished samples. In the embodiments, a wafer will be described as an example of the substrate.

First Embodiment

Firstly, a first embodiment will be described. FIG. 1 is a schematic configuration diagram showing an information processing system according to the first embodiment. As shown in FIG. 1, an information processing system S1 according to the first embodiment includes a load/unload unit 2, two polishing apparatuses 10 as an example, a cleaning unit 5, and a film thickness measuring device 6.

The load/unload unit 2 includes two or more (four in this embodiment) front load units 20 on which a wafer cassette that stocks multiple wafers is mounted. An open cassette, a standard manufacturing interface (SMIF) pod, or a front opening unified pod (FOUP) can be mounted on the front load unit 20.

Here, the SMIF and the FOUP are airtight containers that can secure an environment independent from the external space by storing the wafer cassette therein and covering the wafer cassette with a partition wall. Here, description will be made on the assumption that a FOUP 21 is mounted on one of the front load units 20 as an example. The wafer is transferred from the load/unload unit 2 to the polishing apparatus 10 by a transport robot 22 (see Patent Document 1).

The film thickness measuring device 6 measures the film thickness of a substrate (here, wafer) or the profile of the film thickness (also referred to as the film thickness distribution). The film thickness measuring device 6 is, for example, an optical film thickness measuring device (also referred to as an ITM).

The polishing apparatus 10 includes an AI unit 4. The AI unit 4 outputs any of data regarding the film thickness of the polished substrate, the statistical value of the profile of the film thickness of the polished substrate, or a parameter (for example, yield rate) related to the yield of a product included in the polished substrate, as an estimated value. For example, when the estimated value is out of a predetermined normal polishing condition or satisfies a predetermined polishing deterioration condition, the AI unit 4 causes the film thickness measuring device 6 to measure the film thickness of the polished target substrate. For example, when the estimated value for a wafer W1 in FIG. 1 is out of the predetermined normal polishing condition or satisfies the predetermined polishing deterioration condition, the wafer W1 is cleaned by the cleaning unit 5, and then the film thickness is measured by the film thickness measuring device 6, as shown by an arrow A1. On the other hand, for example, when the estimated value for a wafer W2 in FIG. 1 satisfies the predetermined normal polishing condition or does not satisfy the predetermined polishing deterioration condition, the wafer W2 is cleaned by the cleaning unit 5, and then is brought back to the FOUP 21 without measuring the film thickness by the film thickness measuring device 6, as shown by an arrow A2.

When the normal polishing condition is used, the AI unit 4 may be made to learn the normal data. When the polishing deterioration condition is used, the AI unit 4 may be made to learn the defective data. The ratio between the normal data and the defective data may be determined, and then the AI unit 4 may be made to perform learning.

The output of the AI unit 4 may be divided into three types of being normal, defective, and a defective candidate. When the output means a defective candidate, the film thickness is measured by the film thickness measuring device 6.

Figure 9:
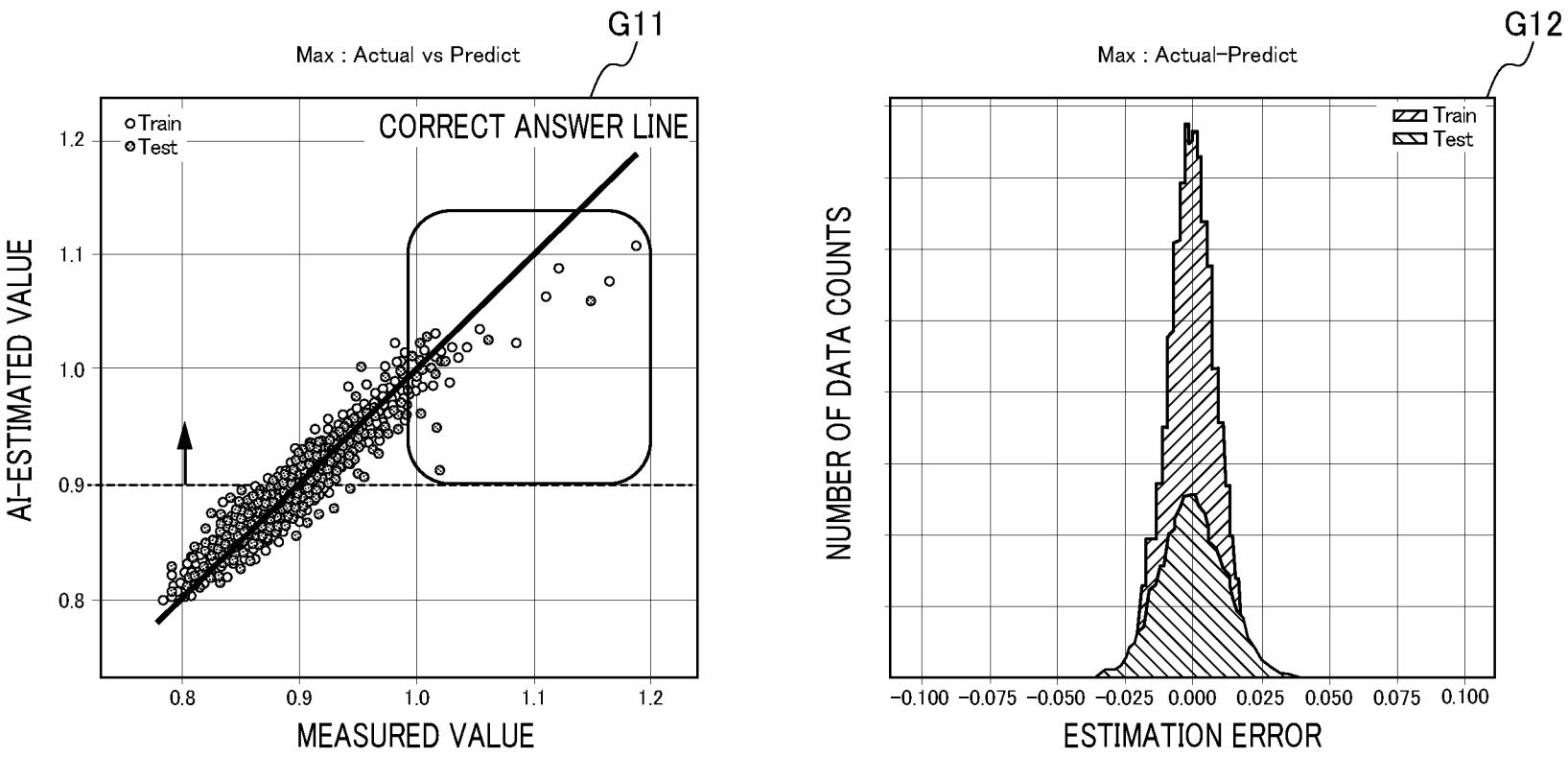
FIG. 9 is a diagram showing a comparison between a measured value and an AI-estimated value of the maximum film thickness value in the first embodiment.

In FIG. 9, for example, when the output estimated value of an AI does not exceed the lower limit threshold value continuously or suddenly exceeds the upper limit threshold value, the AI unit 4 may determine that the substrate is a defective candidate and measure the film thickness.

In addition to or in place of this, when a polishing time is longer than the normal range, the AI unit 4 may determine that the substrate is a defective candidate and measure the film thickness.

The output of the AI unit 4 may be divided into two types of being normal and a defective candidate.

Figure 2:
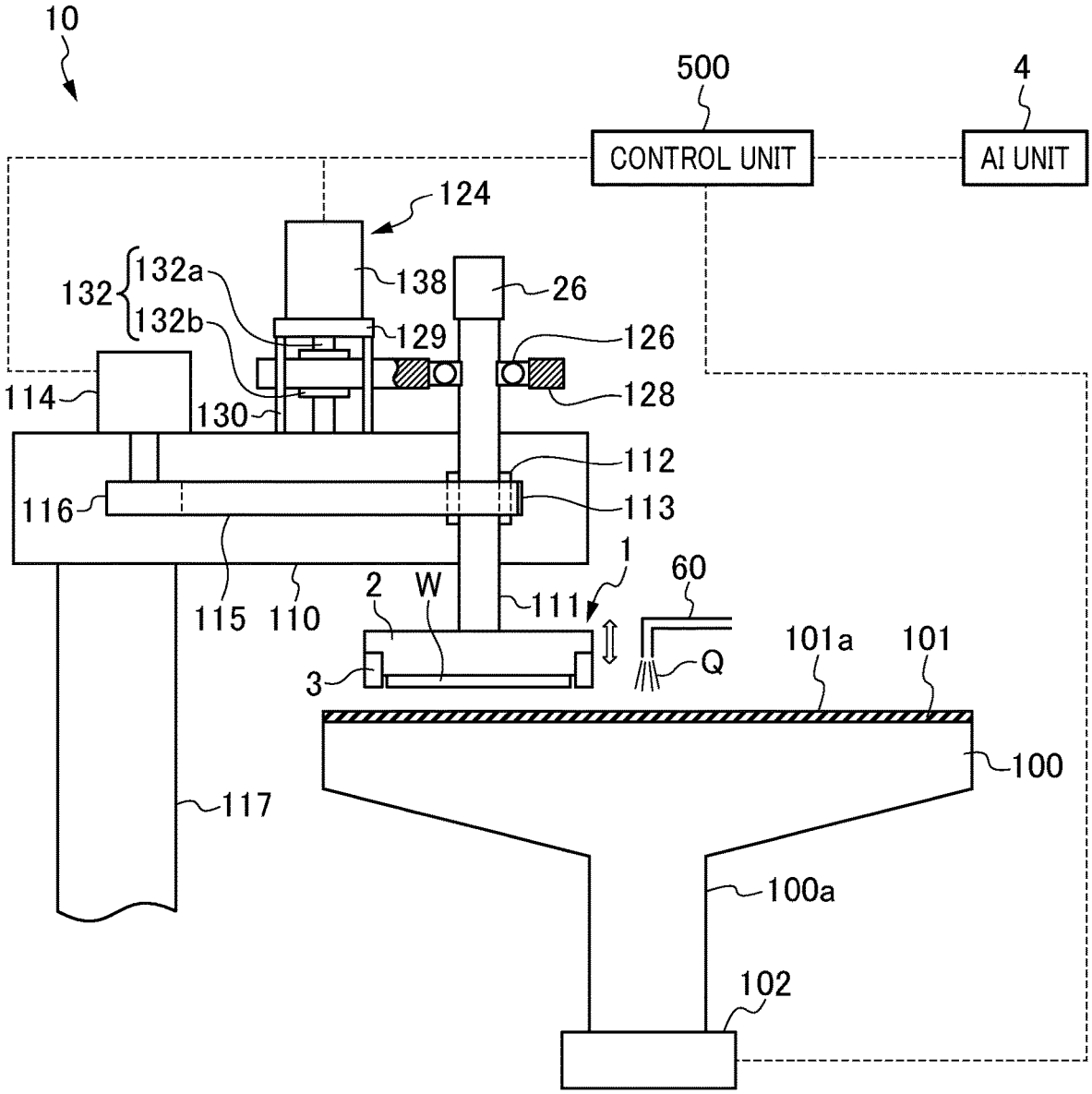
FIG. 2 is a schematic diagram showing an overall configuration of a polishing apparatus according to the first embodiment.

FIG. 2 is a schematic diagram showing an overall configuration of the polishing apparatus according to the first embodiment. As shown in FIG. 2, the polishing apparatus 10 includes a polishing table 100 and a polishing head 1. The polishing head is used as a substrate holding device that holds a substrate (here, wafer) being a polishing target and presses the substrate against a polishing surface on the polishing table 100. The polishing head 1 can also be referred to as a top ring. The polishing table 100 is joined to a table rotation motor 102 disposed below the polishing table 100 via a table shaft 100*a*. The polishing table 100 rotates around the table shaft 100*a* by the rotation of the table rotation motor 102. A polishing pad 101 as a polishing member is attached to the upper surface of the polishing table 100. The surface of the polishing pad 101 constitutes a polishing surface 101*a* for polishing a semiconductor wafer W. As described above, the polishing apparatus 10 includes the polishing table 100 provided with the polishing member (here, polishing pad 101 as an example) and configured to be rotatable, and the polishing head 1 facing the polishing table 100 and configured to be rotatable, wherein a substrate (here, wafer) is attachable to the surface facing the polishing table 100.

A polishing-liquid supply nozzle 60 is installed above the polishing table 100. A polishing liquid (polishing slurry) Q is supplied from the polishing-liquid supply nozzle 60 onto the polishing pad 101 on the polishing table 100.

The polishing head 1 is basically configured by a top ring body 2 and a retainer ring 3 as a retainer member. The top ring body 2 presses the semiconductor wafer W against the polishing surface 101*a*. The retainer ring 3 holds the outer peripheral edge of the semiconductor wafer W to prevent the semiconductor wafer W from popping out from the polishing head 1. The polishing head 1 is connected to a top ring shaft 111. The top ring shaft 111 moves up and down with respect to the top ring head 110 by an up-down movement mechanism 124. Positioning of the polishing head 1 in an up-down direction is performed by moving the top ring shaft 111 up and down to move the entirety of the polishing head 1 up and down with respect to the top ring head 110. A rotary joint 26 is attached to the upper end of the top ring shaft 111.

The up-down movement mechanism 124 that moves the top ring shaft 111 and the polishing head 1 up and down includes a bridge 128 that rotatably supports the top ring shaft 111 via a bearing 126, a ball screw 132 attached to the bridge 128, a support base 129 supported by a support column 130, and a servomotor 138 provided on the support base 129. The support base 129 that supports the servomotor 138 is fixed to the top ring head 110 via the support column 130.

The ball screw 132 includes a screw shaft 132*a* joined to the servomotor 138 and a nut 132*b* into which the screw shaft 132*a* is screwed. When the servomotor 138 is driven, the bridge 128 moves up and down via the ball screw 132, and thus the top ring shaft 111 and the polishing head 1 that move up and down integrally with the bridge 128 move up and down.

As shown in FIG. 2, by rotationally driving a top-ring rotation motor 114, a rotary cylinder 112 and the top ring shaft 111 are integrally rotated via a timing pulley 116, a timing belt 115, and a timing pulley 113 to rotate the polishing head 1.

The top ring head 110 is supported by a top ring head shaft 117 that is rotatably supported by a frame (not shown). The polishing apparatus 10 includes a control unit 500 that is connected to the devices in the apparatus, that include the top-ring rotation motor 114, the servomotor 138, and the table rotation motor 102, via control lines, and controls the devices. The control unit 500 performs control to polish the substrate by pressing the substrate against the polishing member (here, polishing pad 101) while rotating the polishing table 100 and the polishing head 1 to which the substrate is attached.

The input of the machine learning model described later includes table rotation, head rotation, and rotation of a motor (not shown) for swinging the top ring head 110. One or more sensor detection values (for example, motor current value) or the calculated value of the torque calculated from the sensor detection value may be used as the input.

Figure 3:
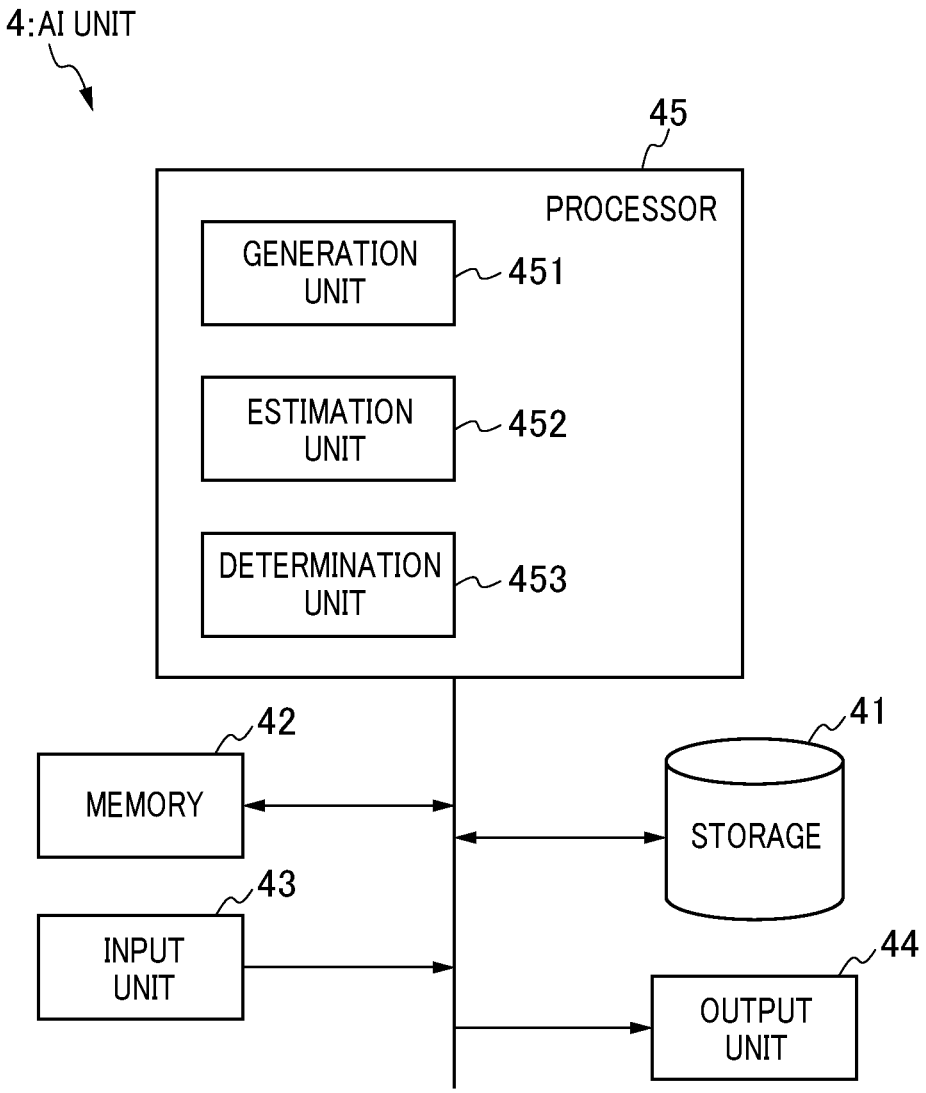
FIG. 3 is a schematic configuration diagram showing an AI unit according to the first embodiment.

The polishing apparatus 10 includes the AI unit 4 connected to the control unit 500 via a wiring. FIG. 3 is a schematic configuration diagram showing the AI unit according to the first embodiment. As shown in FIG. 3, the AI unit 4 is, for example, a computer, and includes a storage 41, a memory 42, an input unit 43, an output unit 44, and a processor 45.

The storage 41 stores a machine learning model. The machine learning model is learned using learning data in which the feature amount of a signal regarding a frictional force between the polishing member (here, polishing pad 101) and the substrate in polishing is input, and data regarding the film thickness of the polished substrate, the statistical value of the profile of the film thickness of the polished substrate, or the parameter related to the yield of a product included in the polished substrate is output. The storage 41 stores a program to be read and executed by the processor 45.

Here, the signal regarding the frictional force between the polishing member and the substrate is, for example, a signal of the current value (also referred to as a table current monitor (TCM)) for calculating the torque of the table rotation motor 102 in polishing.

Here, the signal regarding the frictional force between the polishing member and the substrate may be the calculated value of the torque converted from the current value of the motor. The signal regarding the frictional force between the polishing member and the substrate may be a signal of the drive current value of the top-ring rotation motor 114 that rotates the polishing head 1, or a signal of the drive current value of the motor (not shown) that rotates the top ring head 110 (that is, top ring head shaft 117).

The polishing apparatus 10 may include a load cell that measures the frictional force between the polishing member and the substrate. In this case, the signal regarding the frictional force between the polishing member and the substrate may be a signal of the load cell. The polishing apparatus 10 may include a strain sensor that measures the strain of the substrate. In this case, the signal regarding the frictional force between the polishing member and the substrate may be a signal of the strain sensor.

The memory 42 is a medium that temporarily stores information.

The input unit 43 receives the information from the control unit 500 and outputs the received information to the processor 45.

The output unit 44 receives information from the processor 45 and outputs the received information to the control unit 500.

The processor 45 reads and executes the program from the storage 41 to function as a generation unit 451, an estimation unit 452, and a determination unit 453.

The generation unit 451 generates the feature amount from the signal regarding the frictional force between the polishing member and the substrate in polishing. Here, the term "in polishing" means, for example, a period during when the substrate is polished by pressing the substrate against the polishing member while rotating the polishing table 100 and the polishing head 1 having the substrate attached thereto. The details of this processing will be described later.

The estimation unit 452 outputs, as an estimated value, any of the data regarding the film thickness of the polished substrate or the parameter related to the yield of a product included in the polished substrate, by inputting the feature amount generated by the generation unit 451 to the learned machine learning model. The details of this processing will be described later. Here, the data regarding the film thickness of the polished substrate is, for example, any of the film thickness itself of the polished substrate, the statistical value (for example, mean value, maximum value, minimum value, variation width, and standard deviation of the film thickness distribution) of the film thickness profile of the polished substrate, and the film thickness profile of the polished substrate. Here, the film thickness profile is a film thickness data group (combination of XY coordinates and film thickness) in which a plurality of points are measured at different positions in the wafer.

There are a plurality of chips in the wafer. A defect determination is performed for each chip, and the parameter related to the chip yield in the wafer can be calculated. The yield of the product included in the polished substrate described above is, for example, the chip yield in the wafer.

Figure 4:
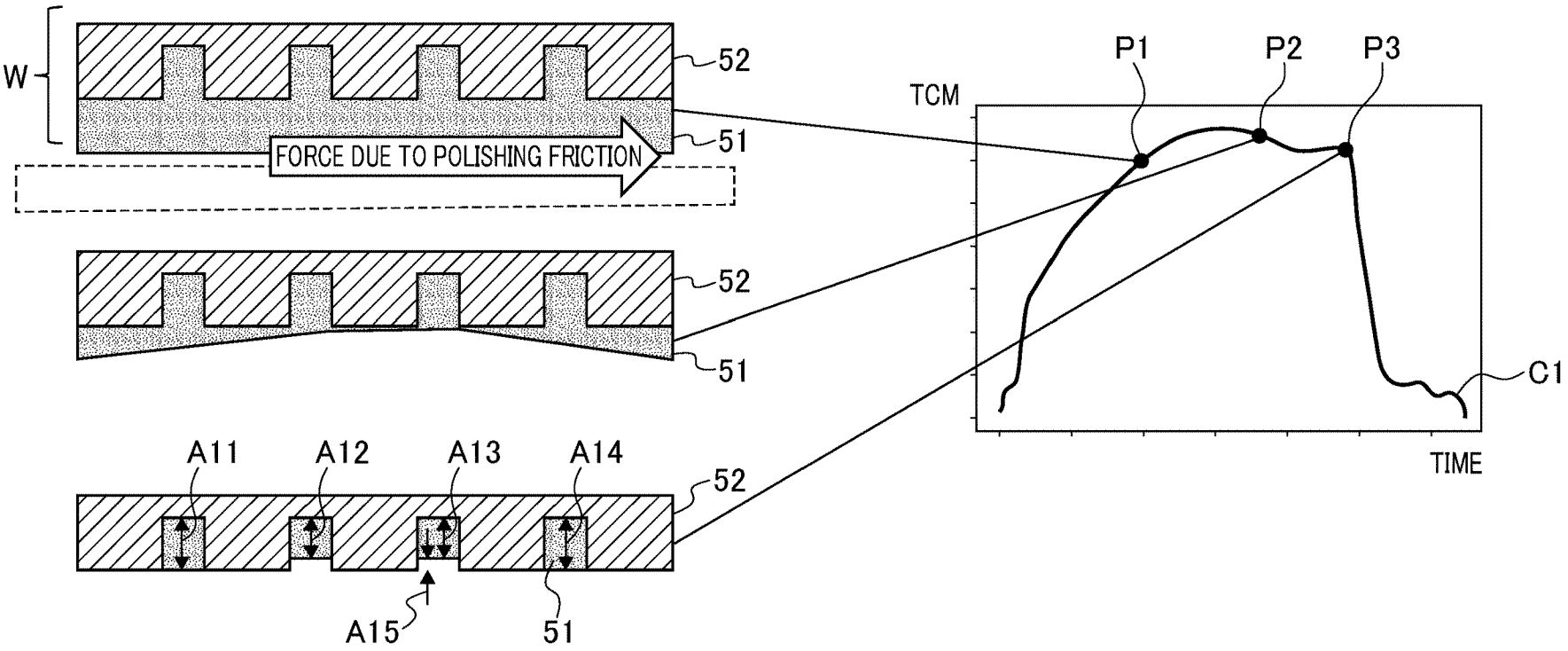
FIG. 4 is a diagram showing a correspondence between a polishing state of a wafer and a waveform of a TCM.

FIG. 4 is a diagram showing the correspondence between the polishing state of the wafer and the waveform of a TCM. The vertical axis of the graph shown in FIG. 4 indicates the torque current value (TCM) of the table rotation motor 102 in polishing, and the horizontal axis indicates time [ms]. A waveform C1 showing the time change in the TCM is shown. Since the frictional force with the polishing pad 101 changes depending on the ratio of the exposed film type, the TCM value also changes accordingly.

As shown in FIG. 4, the wafer W has a polishing target layer 51 attached to face the polishing pad 101, and a lower layer 52 provided on the polishing target layer 51. The polishing target layer 51 is scraped by a force due to friction caused by polishing. At a point P1 on the waveform C1, the polishing target layer 51 is not scraped much. At a point P2 on the waveform C1 after a lapse of time, a part of the lower layer 52 is exposed. At a point P3 on the waveform C1 after further lapse of time, the lower layer 52 is exposed over the entire surface. When the lower layer 52 is exposed over the entire surface, the table rotation motor 102 is stopped and polishing is ended.

As the lengths of arrows A12 and A13 are shorter than the lengths of arrows A11 and A14 in FIG. 4, over-polishing is performed by the length of an arrow A15.

The inventor of the present application has found that, when a film is polished non-uniformly, a timing at which a underlayer is exposed varies within the wafer surface, and thus a TCM signal (waveform of a descending curve as an example in FIG. before a polishing end point has a correlation with a residual film thickness or a residual film thickness profile. Thus, in the present embodiment, the feature amount is generated from the TCM signal for a predetermined period before the polishing end point.

Figure 5:
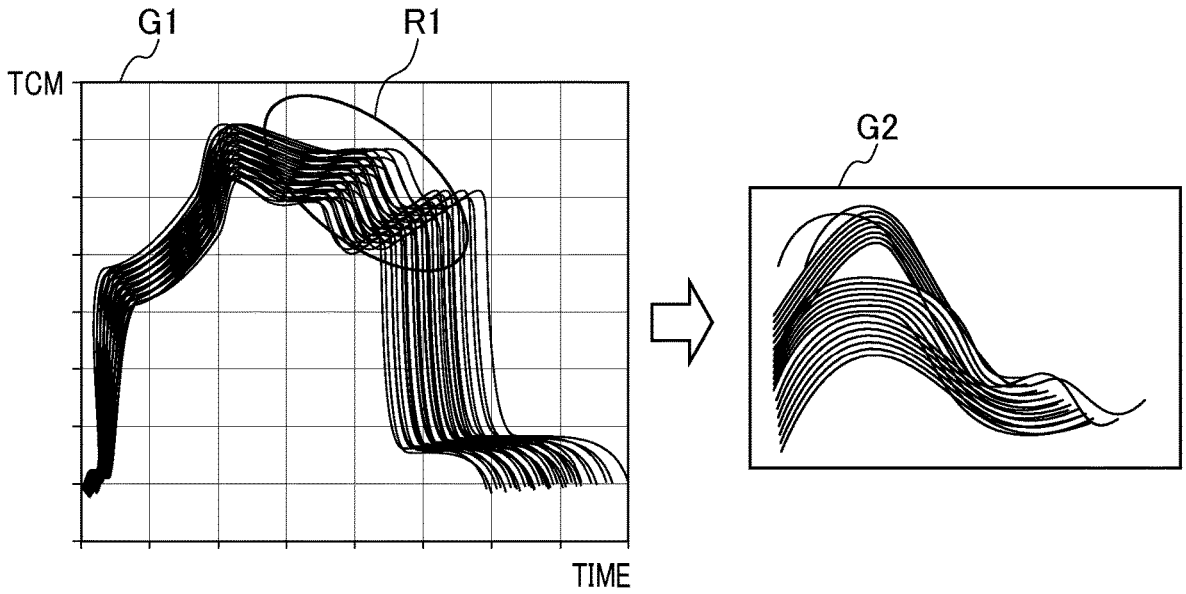
FIG. 5 is a schematic diagram showing a cutout of the waveform of the TCM.

A cutout of a part of a signal used for calculating the feature amount from the TCM signal will be described with reference to FIG. 5. FIG. 5 is a schematic diagram showing a cutout of the waveform of the TCM. In FIG. 5, the vertical axis indicates the TCM, and the horizontal axis indicates time. As shown in FIG. 5, a graph G1 shows the entire waveform of the TCM. A cutout of a region R1 in the graph G1 is a graph G2. As described above, the generation unit 451 according to the present embodiment extracts, for example, data in a predetermined time range from the TCM, and calculates the feature amount from the extracted data. The feature amount is, for example, the value itself of a calculation period (for example, entire period of the extracted data, partial period T1, and partial period T2 after the partial period T1) of the extracted data, and a statistics value (for example, maximum value, minimum value, standard deviation, variance, mean value, median value, kurtosis, or skewness) of the differential value, the moving average value, and the like. Here, the kurtosis is a number representing the sharpness of the frequency distribution, and is calculated by a known calculation method. The skewness is a measure indicating the degree to which the data is not symmetrically distributed around the mean and is calculated by a known calculation method.

Figure 6:
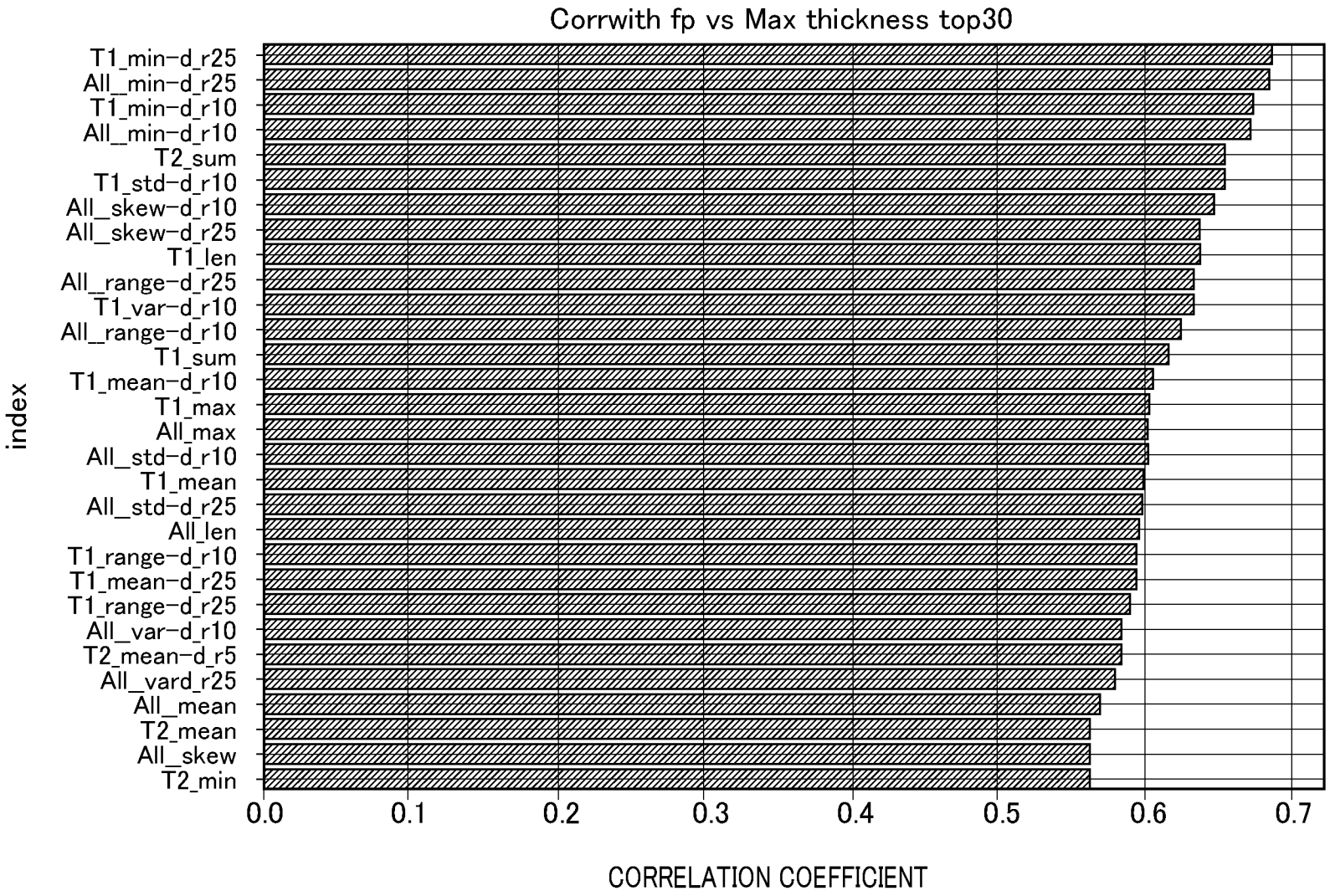
FIG. 6 is a bar graph showing a correlation coefficient between the maximum value of a residual film and each parameter.

An example of the feature amount will be described with reference to FIG. 6. FIG. 6 is a bar graph showing the correlation coefficient between the maximum value of the residual film and each parameter. In FIG. 6, the vertical axis indicates each feature amount, and the horizontal axis indicates the correlation coefficient. It was found that the correlation coefficient between each feature amount on the vertical axis and the maximum value of the residual film was equal to or more than 0.5, and thus the feature amount and the maximum value of the residual film had a correlation.

In FIG. 6, the feature amount T1_min-d_r25 is the minimum value of the derivative of the moving average of 25 pieces of TCM data in a predetermined period T1 in a period of the graph G2 in FIG. 5. All_min-d_r25 is the minimum value of the derivative of the moving average of 25 pieces of TCM data in the entire period of the graph G2 in FIG. 5.

The feature amount T1_min-d_r10 is the minimum value of the derivative of the moving average of 10 pieces of TCM data in the predetermined period T1 in the period of the graph G2 in FIG. 5. All_min-d_r10 is the minimum value of the derivative of the moving average of 10 pieces of TCM data in the entire period of the graph G2 in FIG. 5.

T2_sum is the total value of the TCM in a period T2 after the period T1 in the period of the graph G2 in FIG. 5. T1_std-d_r10 is the standard deviation of the derivative of the moving average of 10 pieces of TCM data in the predetermined period T1 in the period of the graph G2 in FIG. 5. All_skew-d-r10 is the skewness of the derivative of the moving average of 10 pieces of TCM data in the entirety of the period of the graph G2 in FIG. 5. All_skew-d-r25 is the skewness of the derivative of the moving average of 25 pieces of TCM data in the entirety of the period of the graph G2 in FIG. 5. T1_len is the number of pieces of data.

The number (for example, the top 10 parameters) of types of parameters to be used may be determined and used from the upper parameters having a high correlation coefficient, or the application conditions may be determined.

The application condition may be, for example, a condition that a parameter having a correlation coefficient equal to or more than the mean value of the correlation coefficient is used, or a condition that a parameter having a correlation coefficient equal to or more than a value obtained by adding the standard deviation 6 to the mean value of the correlation coefficient.

All_range-d_r25 is the range of the derivative of the moving average of 25 pieces of TCM data in the entire period of the graph G2 in FIG. 5.

T1_var-d_r25 is the variance of the derivative of the moving average of 25 pieces of TCM data in the predetermined period T1 of the period of the graph G2 in FIG. 5. All_range-d_r10 is the range of the derivative of the moving average of 10 pieces of TCM data in the entire period of the graph G2 in FIG. 5.

T1_sum is the total TCM in the predetermined period T1 in the period of the graph G2 in FIG. 5.

T1_mean-d_r10 is the mean of the derivative of the moving average of 10 pieces of TCM data in the predetermined period T1 in the period of the graph G2 in FIG. 5. T1_max is the maximum value of the TCM in the predetermined period T1 in the period of the graph G2 in FIG. 5. All_max is the maximum value of the TCM in the entire period of the graph G2 in FIG. 5. All_std-d_r10 is the standard deviation of the derivative of the moving average of 10 pieces of TCM data in the entire period of the graph G2 in FIG. 5. T1_mean is the mean value of the TCM in the predetermined period T1 in the period of the graph G2 in FIG. 5. All_std-d_r25 is the standard deviation of the derivative of the moving average of 25 pieces of TCM data in the entire period of the graph G2 in FIG. 5. All_len is the number of pieces of data.

T1_range-d_r10 is the range of the derivative of the moving average of 10 pieces of TCM data in the predetermined period T1 in the period of the graph G2 in FIG. 5. T1_mean-d_r25 is the mean of the derivative of the moving average of 25 pieces of TCM data in the predetermined period T1 in the period of the graph G2 in FIG. 5. T1_range-d_r25 is the range of the derivative of the moving average of 25 pieces of TCM data in the predetermined period T1 in the period of the graph G2 in FIG. 5. All_var-d_r10 is the variance of the derivative of the moving average of 10 pieces of TCM data in the entire period of the graph G2 in FIG. 5.

T2_mean-d_r5 is the mean of the derivative of the moving average of 5 pieces of TCM data in the period T2 after the period T1 in the period of the graph G2 in FIG. 5. All_var-d_r25 is the variance of the derivative of the moving average of 25 pieces of TCM data in the entire period of the graph G2 in FIG. 5. All_mean is the mean of the TCM in the entire period of the graph G2 in FIG. 5. T2_mean is the mean of the TCM in the period T2 after the period T1 in the period of the graph G2 in FIG. 5. All_skew is the skewness of the TCM in the entire period of the graph G2 in FIG. 5. T2_min is the minimum value of the TCM in the period T2 after the period T1 in the period of the graph G2 in FIG. 5.

The AI (artificial intelligence) model used by the estimation unit 452 of the AI unit 4 may be, for example, Light Gradient Boosting Machine (LightGBM) disclosed in Non-Patent Document 1. LightGBM is a machine learning model based on a search tree.

Figure 7:
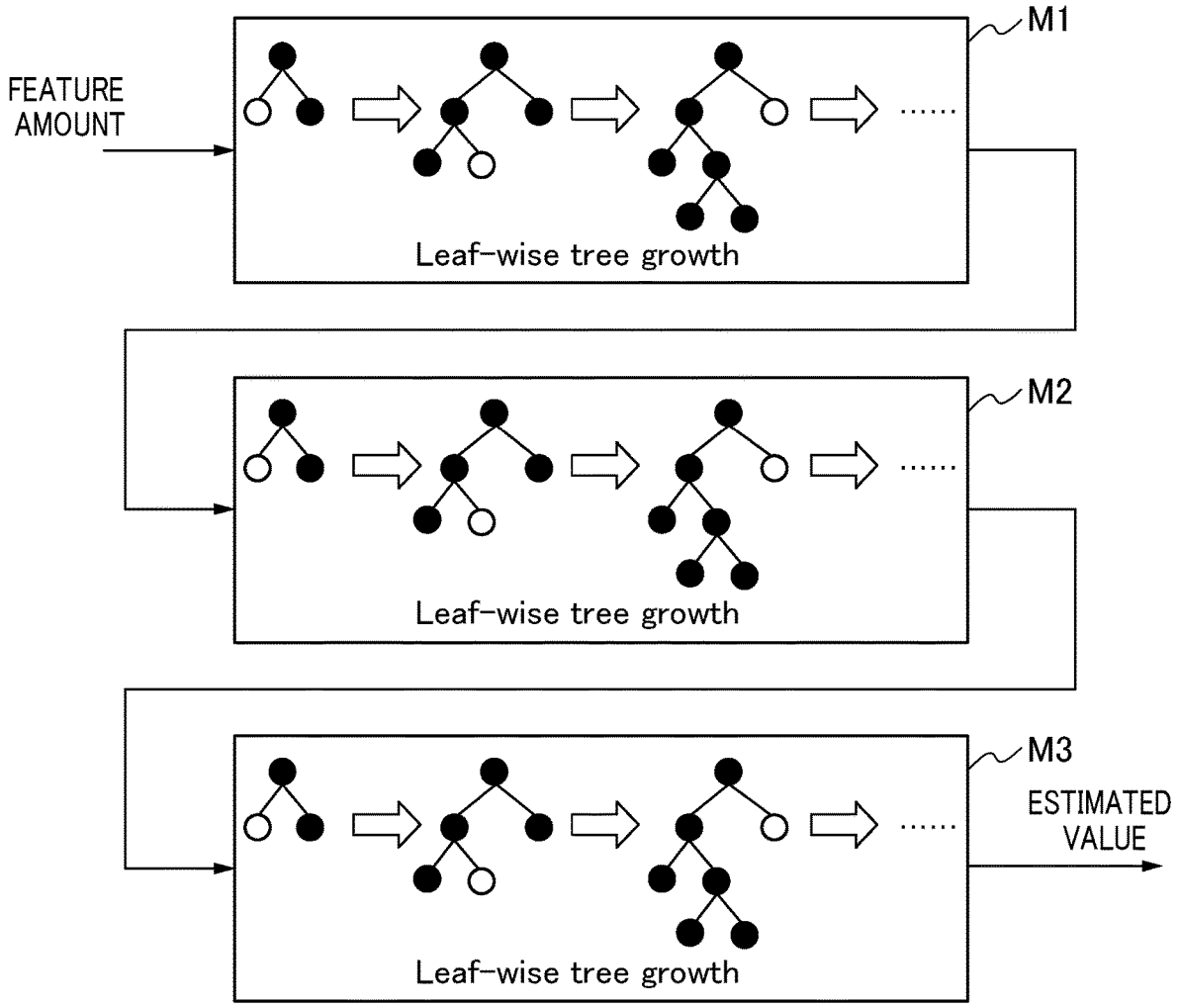
FIG. 7 is a schematic diagram showing an example of an outline of LightGBM.

FIG. 7 is a schematic diagram showing an example of an outline of LightGBM. In FIG. 7, a first search tree M1, a second search tree M2, and a third search tree M3 are provided as an example. Model training is performed on the first search tree M1 and the estimation results are evaluated. The training of the second search tree M2 is performed using the "error" between the estimation result of the first search tree M1 and the actual value as training data. Similarly, the training of the third search tree M3 is performed using the "error" between the estimation result of the second search tree M2 and the actual value as training data. When the feature amount is input to the first search tree M1 after the training is completed, the estimated value is output from the third search tree M3. The method of handling decision trees in the training process of gradient boosting is a method referred as "Leaf-wise tree growth", which grows based on the leaves of the decision trees.

Figure 8:
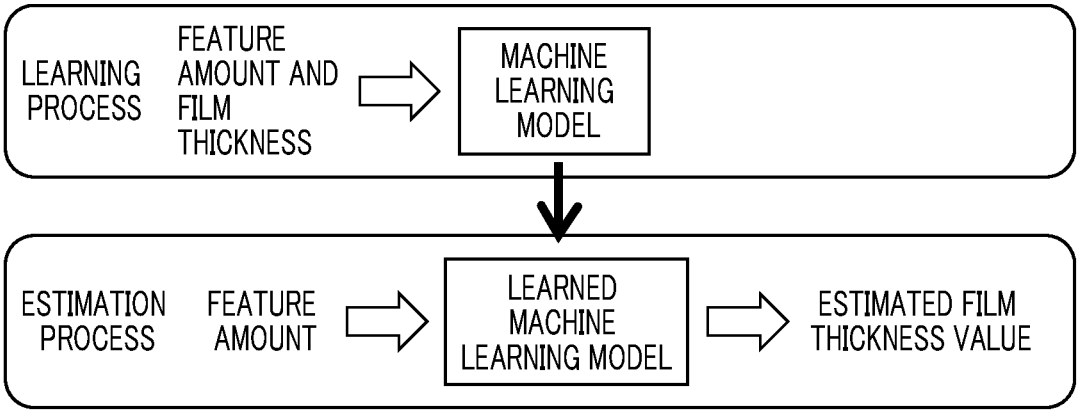
FIG. 8 is a schematic diagram showing an example of a learning process and an estimation process.

FIG. 8 is a schematic diagram showing an example of a learning process and an estimation process. As shown in FIG. 8, in the learning process, the AI unit 4 learns the machine learning model using learning data in which the feature amount is input, and the estimated film thickness value is output. Then, in the estimation process, when the feature amount is input to the learned machine learning model, for example, the estimated film thickness value is output from the machine learning model. As described above, the AI unit 4 outputs the estimated film thickness value in response to the input feature amount, by using the learned machine learning model. For example, the AI unit 4 compares the estimated film thickness value with the set threshold value to determine whether the wafer is normal or a defective candidate. When the wafer is determined to be a defective candidate, the AI unit 4 may perform control to transport the wafer to the film thickness measuring device. Thus, the actual film thickness of the wafer is measured when the wafer is determined to be a defective candidate.

In the present embodiment, after the data obtained by previous polishing is divided into learning data and test data, the AI is trained using only the learning data for learning, estimation is performed for all pieces of data by the AI, and the estimated value is compared with the actual measured value. The comparison results for the maximum film thickness value, the average film thickness value, and the film thickness range will be described below.

FIG. 9 is a diagram showing a comparison between the measured value and the AI-estimated value of the maximum film thickness value in the first embodiment. As shown in FIG. 9, in the graph G11, the vertical axis is the AI-estimated value of the maximum film thickness value standardized by the maximum allowable film thickness, and the horizontal axis is the measured value of the maximum film thickness value standardized by the maximum allowable film thickness. The AI-estimated values are distributed near the correct answer line, and this indicates that the estimates are working. In the graph G12, the vertical axis indicates the number of data counts, and the horizontal axis indicates the estimation error (=measured value of the maximum film thickness value—AI-estimated value of the maximum film thickness value). Train indicates the training data.

Test indicates the test data. In both cases, the estimation error is within a predetermined range.

For example, the determination unit 453 may perform determination of measuring the film thickness when the AI-estimated value of the maximum film thickness standardized by the maximum allowable film thickness exceeds the first threshold value. Thus, when the AI-estimated value exceeds the first threshold value, the control of measuring the film thickness may be performed because there is a possibility that a wafer having uncut parts exceeding the maximum allowable film thickness value is included. Thus, it is possible to set the condition for measuring the film thickness without missing the defective product, by using the AI-estimated value as the determination value. In this example, by using the AI-estimated value, it was found that only about 25% of the substrates need to be measured. Specifically, the determination unit 453 may control one or more robots (for example, transporter 7, transport robot 22, and transport robot 53, see Patent Document 1) to move the wafer to the film thickness measuring device 6 after polishing.

Figure 10:
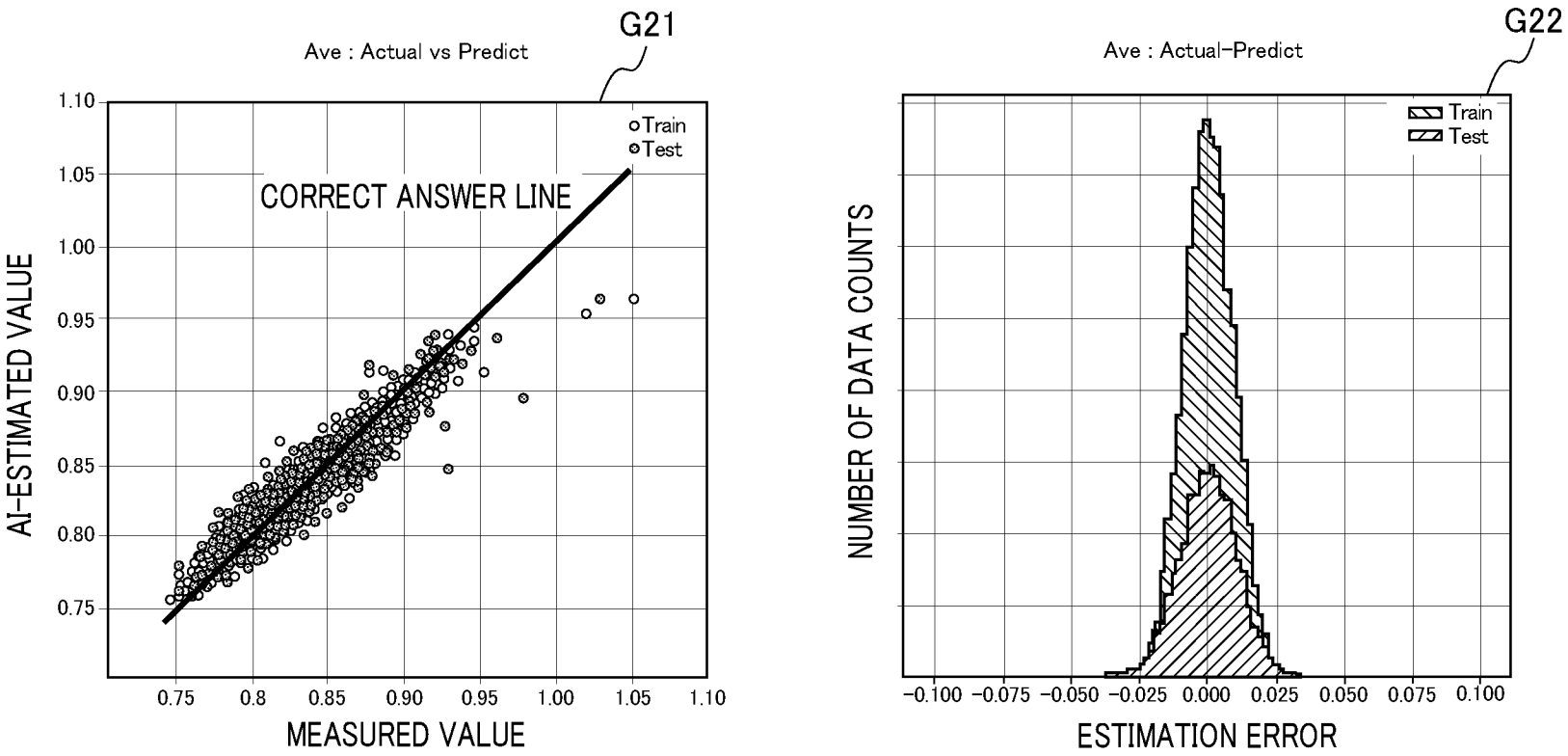
FIG. 10 is a diagram showing a comparison between a measured value and an AI-estimated value of an average film thickness value in the first embodiment.

FIG. 10 is a diagram showing a comparison between the measured value and the AI-estimated value of the average film thickness value in the first embodiment. As shown in FIG. 10, in the graph G21, the vertical axis indicates the AI-estimated value of the standardized average film thickness value, and the horizontal axis indicates the measured value of the standardized average film thickness value. The AI-estimated values are distributed near the correct answer line, and this indicates that the estimates are working. In the graph G22, the vertical axis is the number of data counts, and the horizontal axis is the estimation error (=measured value of the average film thickness value—AI-estimated value of the average film thickness value). Train indicates learning data. Test indicates test data.

Figure 11:
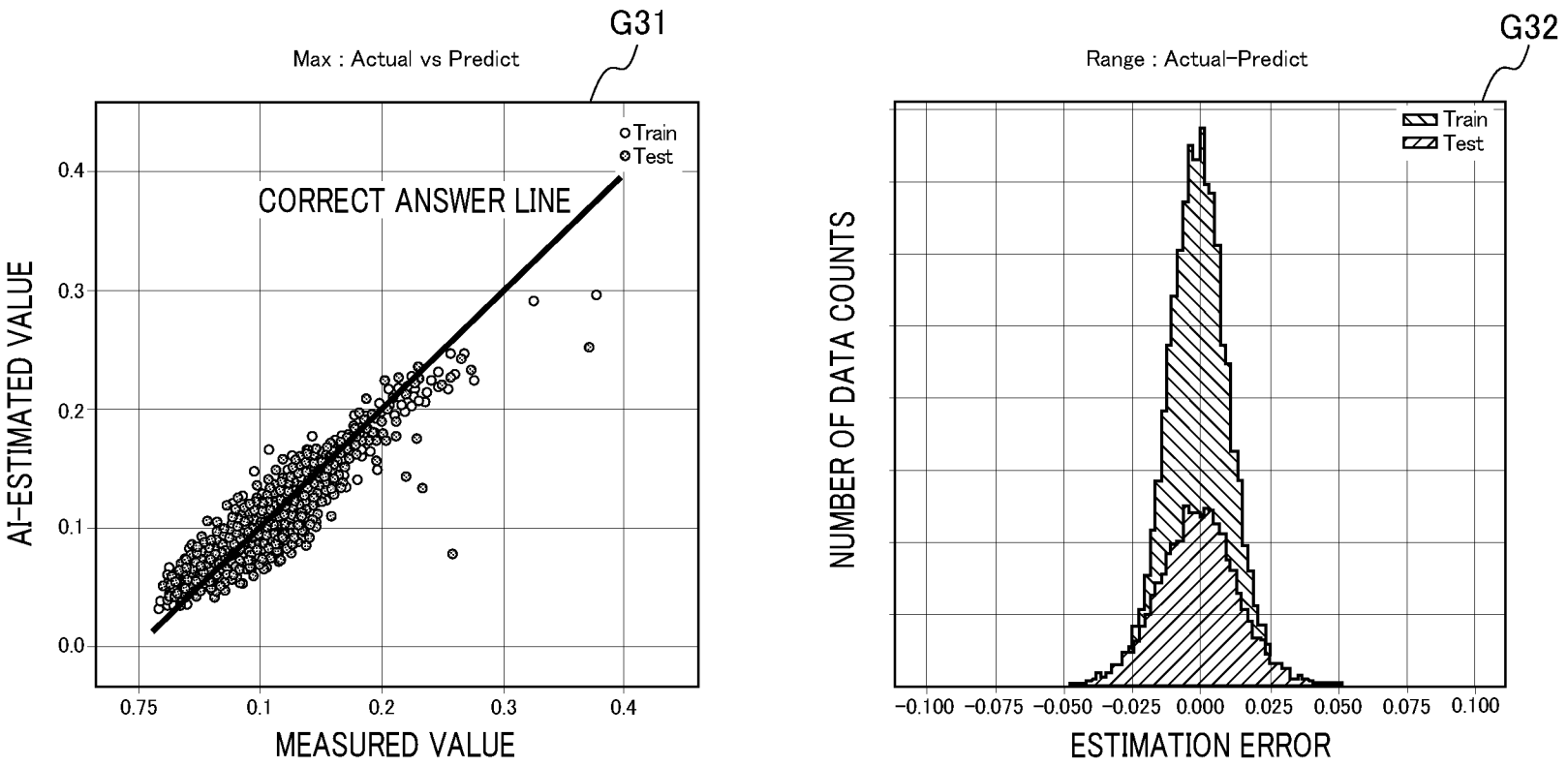
FIG. 11 is a diagram showing a comparison between a measured value and an AI-estimated value of a film thickness range in the first embodiment.

FIG. 11 is a diagram showing a comparison between the measured value and the AI-estimated value of the film thickness range in the first embodiment. As shown in FIG. 11, in the graph G31, the vertical axis indicates the AI-estimated value of the standardized film thickness range, and the horizontal axis indicates the measured value of the standardized film thickness range. The AI-estimated values are distributed near the correct answer line, and this indicates that the estimates are working. In the graph G32, the vertical axis indicates the number of data counts, and the horizontal axis indicates the estimation error (=measured value of the film thickness range—AI-estimated value of the film thickness range). Train indicates learning data. Test indicates test data.

Figure 12:
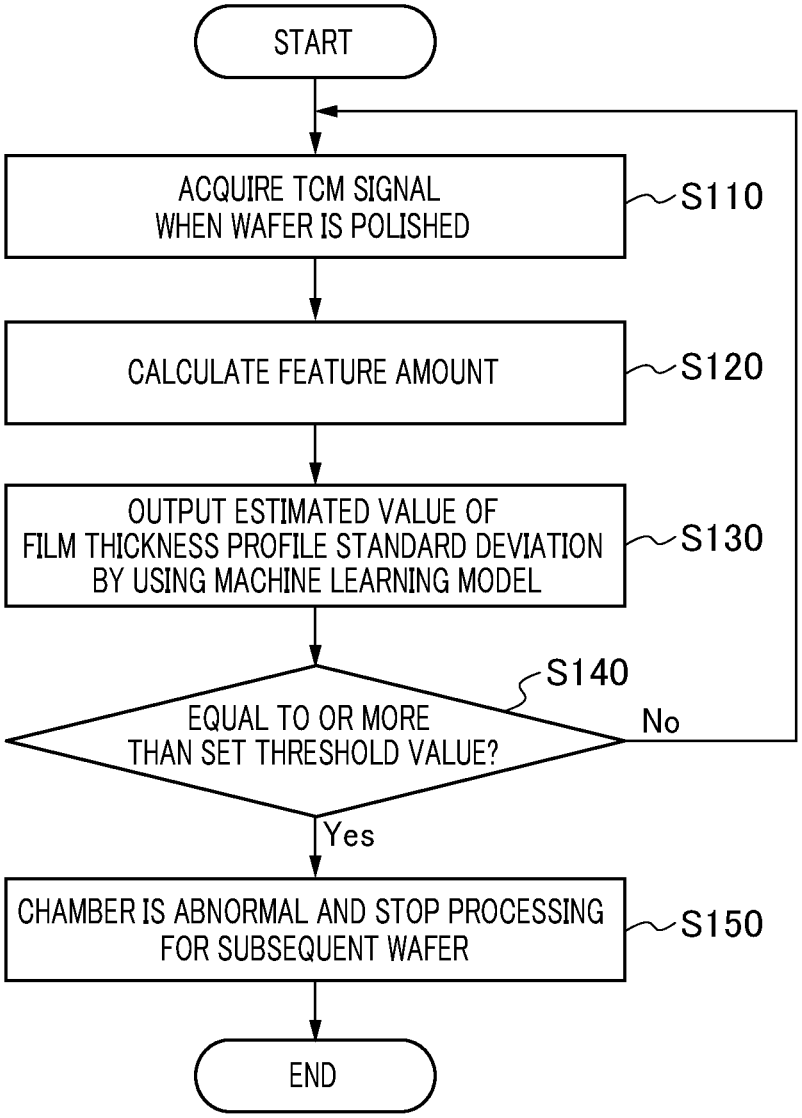
FIG. 12 is a flowchart showing an example of processing of stopping processing for a subsequent substrate that satisfies a polishing deterioration condition.

Next, an example of processing of stopping processing for the subsequent substrate when the estimated value output from the estimation unit 452 satisfies the predetermined polishing deterioration condition will be described with reference to FIG. 12. FIG. 12 is a flowchart showing an example of processing of stopping processing for a subsequent substrate that satisfies a polishing deterioration condition.

Figure 13:
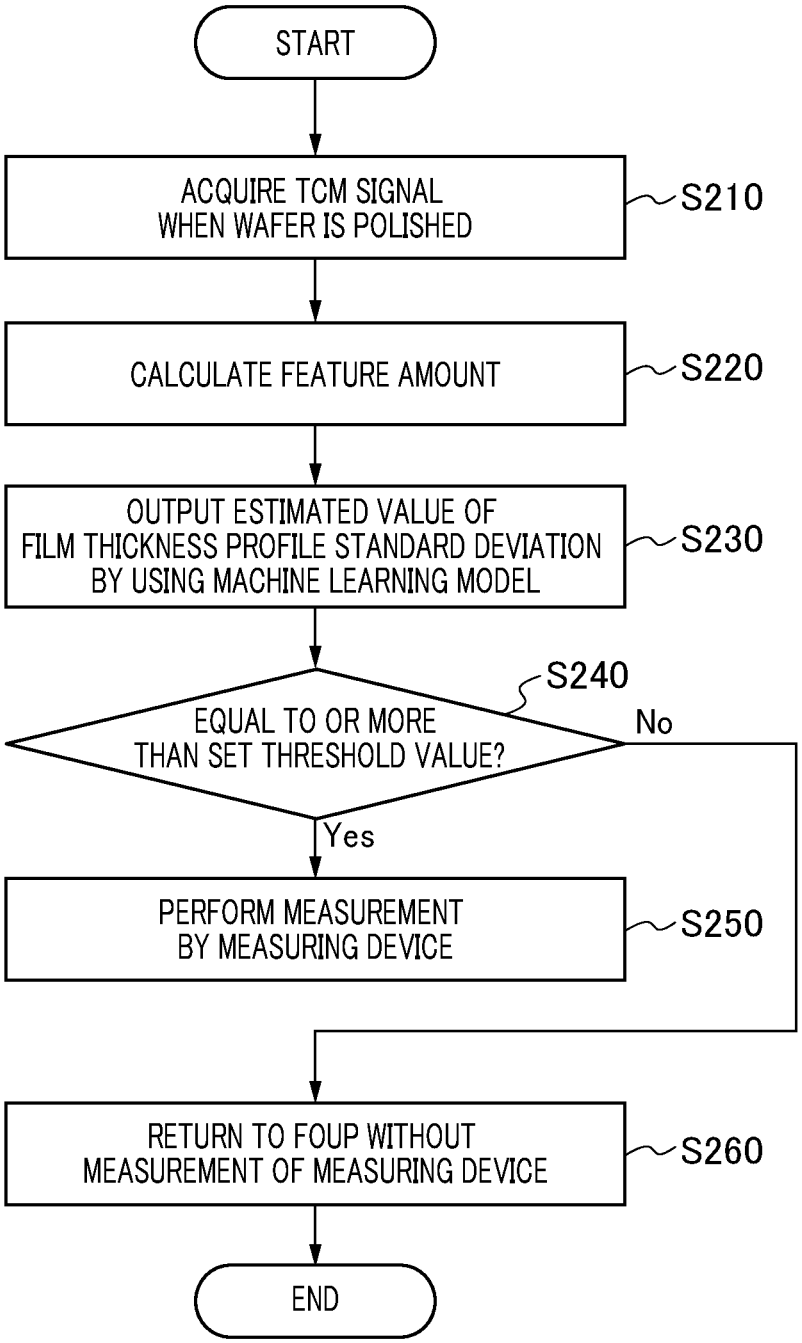
FIG. 13 is a flowchart showing an example of processing in which a film thickness measuring device in an apparatus measures a film thickness when the polishing deterioration condition is satisfied.
Figure 14:
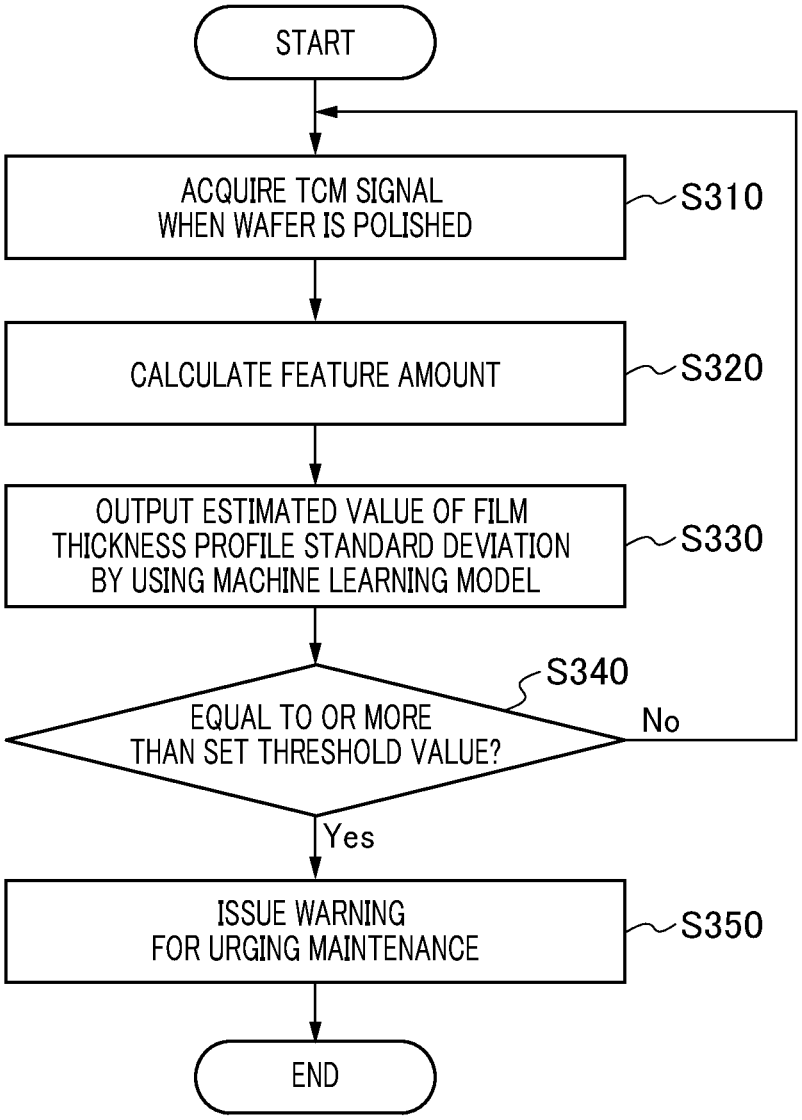
FIG. 14 is a flowchart showing another example of the processing in which the film thickness measuring device in the apparatus measures the film thickness when the polishing deterioration condition is satisfied.

Here, the determination unit 453 determines whether or not the estimated value output by the estimation unit 452 satisfies the predetermined polishing deterioration condition. As an example, when the polishing deterioration condition is a condition that "the estimated value is out of the set range", the determination unit 453 determines whether or not the estimated value output by the estimation unit 452 is out of the set range. In FIGS. 12 to 14, as an example, the polishing deterioration condition is set to a condition that "the estimated value of the standard deviation of the film thickness profile is equal to or more than the set threshold value", and the determination unit 453 determines whether or not the estimated value of the standard deviation of the film thickness profile output by the estimation unit 452 is equal to or more than the set threshold value.

(Step S110) Firstly, the processor 45 acquires a TCM signal when a wafer is polished.

(Step S120) Then, the generation unit 451 calculates the feature amount from the acquired TCM signal.

(Step S130) Then, the estimation unit 452 inputs the feature amount to the learned machine learning model stored in the storage 41, and outputs, for example, the estimated value of the standard deviation of the film thickness profile. Here, the learned machine learning model is, for example, a model in which learning data in which the feature amount of the TCM signal is input, and the standard deviation of the film thickness profile is output is learned.

(Step S140) Then, the determination unit 453 determines whether or not the estimated value of the standard deviation of the film thickness profile is equal to or more than the set threshold value. When the standard deviation of the film thickness profile is not equal to or more than the set threshold value (that is, when the standard deviation of the profile is less than the set threshold value), the process returns to Step S110 and the subsequent processes are repeated.

(Step S150) On the other hand, when it is determined in Step S140 that the estimated value of the standard deviation of the film thickness profile is equal to or more than the set threshold value, the determination unit 453 controls the control unit 500 to stop the processing for the subsequent wafer. Thus, the control unit 500 performs control to stop the processing for the subsequent wafer.

As described above, when the estimated value output from the estimation unit 452 satisfies the predetermined polishing deterioration condition, the processor 45 may stop the processing for the subsequent substrate. Thus, when a polishing state deteriorates, processing for the subsequent substrate is stopped, so that it is possible to perform the maintenance such as replacement of the polishing member. Thus, it is possible to prevent the polishing state from further deterioration.

Next, processing in which the film thickness measuring device inside or outside the apparatus measures the film thickness when the estimated value satisfies the predetermined polishing deterioration condition will be described. FIG. 13 is a flowchart showing an example of the processing in which the film thickness measuring device in the apparatus measures the film thickness when the polishing deterioration condition is satisfied.

(Step S210) Firstly, the processor 45 acquires a TCM signal when a wafer is polished.

(Step S220) Then, the generation unit 451 calculates the feature amount from the acquired TCM signal.

(Step S230) Then, the estimation unit 452 inputs the feature amount to the learned machine learning model stored in the storage 41, and outputs, for example, the estimated value of the standard deviation of the film thickness profile. Here, the learned machine learning model is, for example, a model in which learning data in which the feature amount of the TCM signal is input, and the standard deviation of the film thickness profile is output is learned.

(Step S240) Then, the determination unit 453 determines whether or not the estimated value of the standard deviation of the film thickness profile is equal to or more than the set threshold value.

(Step S250) When it is determined in Step S240 that the estimated value of the standard deviation of the film thickness profile is equal to or more than the set threshold value, the processor 45 controls one or more robots (for example, transporter 7, transport robot 22, and transport robot 53, see Patent Document 1) so that the film thickness measuring device 6 measures the film thickness of the polished wafer.

(Step S260) When the estimated value of the standard deviation of the film thickness profile is not equal to or more than the set threshold in Step S240 (that is, the standard deviation of the profile is less than the set threshold), the processor 45 controls one or more robots (for example, transporter 7, transport robot 22, and transport robot 53, see Patent Document 1) so that the wafer is brought back to the FOUP without measurement of the film thickness measuring device 6.

As described above, when the estimated value output by the estimation unit 452 satisfies the predetermined polishing deterioration condition, the processor 45 controls the film thickness measuring device 6 to measure the film thickness of the polished target substrate. When the estimated value output by the estimation unit 452 does not satisfy the predetermined polishing deterioration condition, the processor controls the film thickness measuring device 6 not to measure the film thickness of the polished target substrate. Thus, when the polishing state deteriorates, the film thickness of the substrate is measured, so that it is possible to determine whether or not the polishing is successful. In addition, when the polishing state does not deteriorate, the film thickness of the substrate is set not to be measured, and thus it is possible to improve the throughput.

Next, the processing in which the film thickness measuring device inside or outside the apparatus measures the film thickness when the estimated value satisfies the predetermined polishing deterioration condition will be described. FIG. 14 is a flowchart showing another example of the processing in which the film thickness measuring device in the apparatus measures the film thickness when the polishing deterioration condition is satisfied.

(Step S310) Firstly, the processor 45 acquires a TCM signal when a wafer is polished.

(Step S320) Then, the generation unit 451 calculates the feature amount from the acquired TCM signal.

(Step S330) Then, the estimation unit 452 inputs the feature amount to the learned machine learning model stored in the storage 41, and outputs, for example, the estimated value of the standard deviation of the film thickness profile. Here, the learned machine learning model is, for example, a model in which learning data in which the feature amount of the TCM signal is input, and the standard deviation of the film thickness profile is output is learned.

(Step S340) Then, the determination unit 453 determines whether or not, for example, the estimated value of the standard deviation of the film thickness profile is equal to or more than the set threshold value. When the estimated value of the standard deviation of the film thickness profile is not equal to or more than the set threshold value (that is, when the standard deviation of the profile is less than the set threshold value), the process returns to Step S310 and the subsequent processes are repeated.

(Step S350) On the other hand, when it is determined in Step S340 that the estimated value of the standard deviation of the film thickness profile is equal to or more than the set threshold value, the processor 45 performs control to output a warning for urging the maintenance. The warning may be voice. The warning may be displayed on a display device. When a light source (for example, PATLITE (registered trademark)) of a plurality of colors (for example, three colors of red, yellow, and green) is provided, PATLITE of a specific color (for example, yellow) may be turned on (or blink). Vibration may be generated. A user may be notified of the warning by transmitting an e-mail to the user so that the user of the polishing apparatus 10 can be automatically contacted. Two or more of the above methods may be combined.

As described above, when the estimated value output by the estimation unit 452 satisfies the predetermined polishing deterioration condition, the processor 45 performs the control to issue the warning for urging the maintenance. Thus, when the polishing state deteriorates, it is possible to perform the maintenance such as replacement of the polishing member, and thus to prevent the polishing state from further deterioration.

Figure 15:
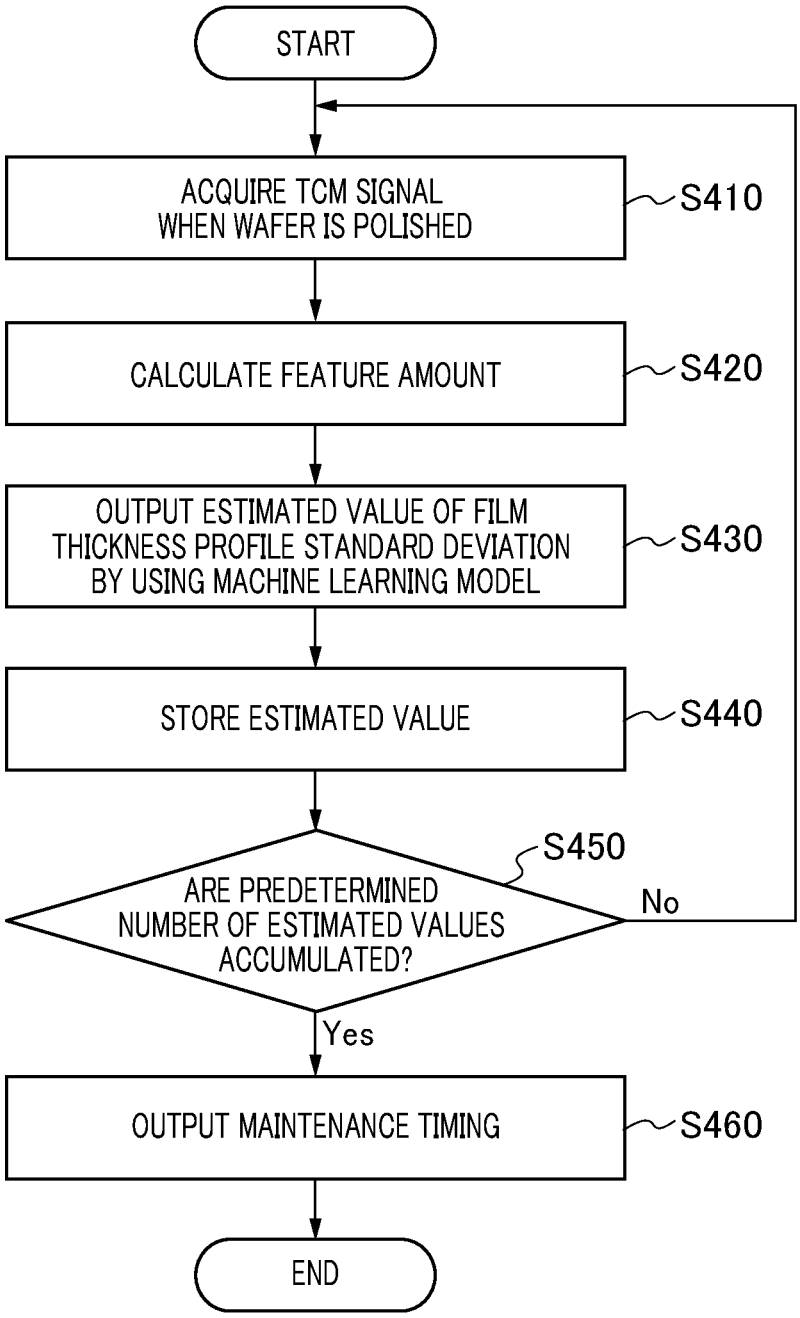
FIG. 15 is a flowchart showing an example of processing of issuing a warning for urging a maintenance when the polishing deterioration condition is satisfied.

Next, processing of issuing the warning for urging the maintenance when the polishing deterioration condition is satisfied will be described with reference to FIG. 15. FIG. 15 is a flowchart showing an example of the processing of issuing the warning for urging the maintenance when the polishing deterioration condition is satisfied.

(Step S410) Firstly, the processor 45 acquires a TCM signal when a wafer is polished.

(Step S420) Then, the generation unit 451 calculates the feature amount from the acquired TCM signal.

(Step S430) Then, the estimation unit 452 inputs the feature amount to the learned machine learning model stored in the storage 41, and outputs, for example, the estimated value of the standard deviation of the film thickness profile. Here, the learned machine learning model is, for example, a model in which learning data in which the feature amount of the TCM signal is input, and the standard deviation of the film thickness profile is output is learned.

(Step S440) Then, the estimation unit 452 stores the estimated value in the storage 41.

(Step S450) Then, the determination unit 453 determines whether or not a predetermined number of estimated values are accumulated. When the predetermined number of estimated values are not accumulated, the process returns to Step S410 and the subsequent processes are repeated.

(Step S460) On the other hand, when it is determined in Step S450 that the predetermined number of estimated values are accumulated, the processor 45 refers to the estimated values output for the polished substrate at a plurality of different times, which are stored in the storage 41, and outputs the maintenance timing by using the tendency of the estimated value output for the polished substrate at the plurality of different times. The output aspect of the maintenance timing may be "recommending maintenance after O hours". The processor 45 may notify the user of the polishing apparatus of the maintenance timing. Thus, the notification of the maintenance timing is automatically performed. In this notification method, the maintenance timing may be displayed on a WEB screen or an application, or an e-mail may be transmitted to the user.

Alternatively, the processor 45 may notify the user of the polishing apparatus when the time reaches the maintenance timing. Thus, the notification of the maintenance timing is automatically performed. In this notification method, a message indicating that it is time to perform the maintenance may be displayed on a WEB screen or an application, or an e-mail may be transmitted to the user.

Specifically, for example, the processor 45 may store the estimated value of the standard deviation of the film thickness profile at set time intervals, calculate the variation of the estimated value per unit time, which is obtained by dividing the difference of the estimated value by the set time interval, and output a timing at which the estimated value is equal to or more than the set threshold value, as the maintenance timing. Thus, it is possible to predict a timing at which the polishing state deteriorates, and perform the maintenance such as replacement of the polishing member at this timing. Thus, it is possible to prevent the polishing state from further deterioration.

In addition, the processor 45 may adjust the polishing condition for the subsequent substrate in accordance with the estimated value output by the estimation unit 452 so that data regarding a desired film thickness of a polished substrate or a parameter related to desired yield of a product included in the polished substrate is obtained. Thus, it is possible to change the polishing condition for the subsequent substrate so that the polishing state is improved. Thus, it is possible to maintain the favorable polishing state for a longer time.

The processor 45 may learn the machine learning model again by using the feature amount during an operation of the polishing apparatus. Thus, it is possible to improve the estimation accuracy.

As described above, the polishing apparatus 10 according to the first embodiment is capable of referring to the storage 41 that stores the machine learning model learned using the learning data in which the feature amount of the signal regarding the frictional force between the polishing member and the substrate in polishing is input, and data regarding the film thickness of the polished substrate or the parameter related to the yield of a product included in the polished substrate is output. The polishing apparatus 10 includes the polishing table 100 provided with the polishing member and configured to be rotatable, the polishing head 1 facing the polishing table 100 and configured to be rotatable, wherein the substrate is attachable to the surface facing the polishing table 100, and the control unit 500 that performs control to polish the substrate by pressing the substrate against the polishing member while rotating the polishing table and the polishing head having the substrate attached thereto.

The polishing apparatus 10 includes the processor 45. The processor 45 generates the feature amount from the signal regarding the frictional force between the polishing member and the substrate in polishing or from the temperature of the polishing member or the target substrate in polishing, and outputs, as the estimated value, any of the data regarding the film thickness of the polished substrate or the parameter related to the yield of a product included in the polished substrate, by inputting the generated feature amount to the learned machine learning model.

With this configuration, during polishing of a polishing apparatus, an estimated value of data regarding a film thickness of the polished substrate or an estimated value of a parameter related to the yield of a product included in the polished substrate is obtained. Thus, it is possible to predict the state of the substrate after polishing without measuring the film thickness. Thus, it is possible to recognize the state of the substrate after polishing without measuring the film thickness and to reduce the number of times of measuring the film thickness. Accordingly, it is possible to improve the throughput without missing a defective product. It is possible to improve the throughput by omitting the film thickness measurement in a case of normal polishing as described above. In addition, it is possible to detect or predict defects by estimating the parameter related to the yield. Further, it is possible to improve the yield by updating a polishing parameter in accordance with the parameter related to the yield.

The AI unit 4 may be mounted on a gateway in a factory, which is a gateway to which the polishing apparatus is connected via a network line. The gateway is preferably in the vicinity of the polishing apparatus. When high-speed processing is required (for example, when the sampling speed is 100 ms or less), the AI unit 4 in the polishing apparatus or the AI unit 4 mounted on the gateway may execute the edge computing. The AI unit 4 in the polishing apparatus may be mounted on a PC or a controller for the apparatus.

Second Embodiment

Next, a second embodiment will be described. The second embodiment is different from the first embodiment that the polishing apparatus 10 includes the AI unit 4 in the first embodiment, but, in the second embodiment, the AI unit 4 is provided in a factory management room, a clean room, or the like in a factory instead of the polishing apparatus.

Figure 16:
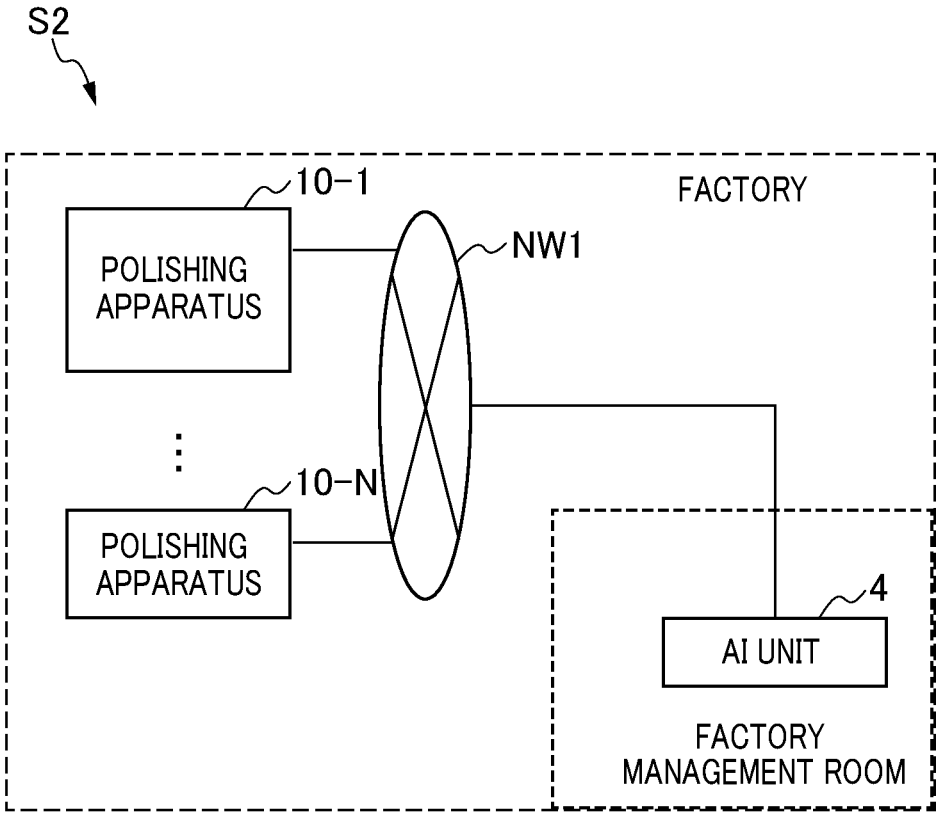
FIG. 16 is a schematic diagram showing an overall configuration of a polishing system according to a second embodiment.

FIG. 16 is a schematic diagram showing an overall configuration of a polishing system according to the second embodiment. As shown in FIG. 16, a polishing system S2 according to the second embodiment includes polishing apparatuses 10-1 to 10-N and the AI unit 4 provided in an identical factory to the factory in which the polishing apparatuses 10-1 to 10-N are provided, or in a factory management room. The AI unit 4 can communicate with the polishing apparatuses 10-1 to 10-N via a local network NW1. The AI unit 4 is mounted on, for example, a computer (for example, server or fog (computing)).

When the AI unit 4 is provided in the polishing apparatus or in the gateway, high-speed processing can be performed by performing the learned machine learning model by edge computing. For example, on-time (real-time) high-speed processing can be performed.

Further, when the AI unit 4 is mounted on a server or fog (computing) in the factory, the machine learning model may be updated by collecting data of a plurality of polishing apparatuses in the factory. In addition, the data of a plurality of polishing apparatuses in the factory may be collected and analyzed, and the analysis result may be applied in the polishing parameter setting.

Third Embodiment

Next, a third embodiment will be described. The third embodiment is different from the first embodiment that the polishing apparatus 10 includes the AI unit 4 in the first embodiment, but, in the third embodiment, the AI unit 4 is provided in a cloud instead of the polishing apparatus.

Figure 17:
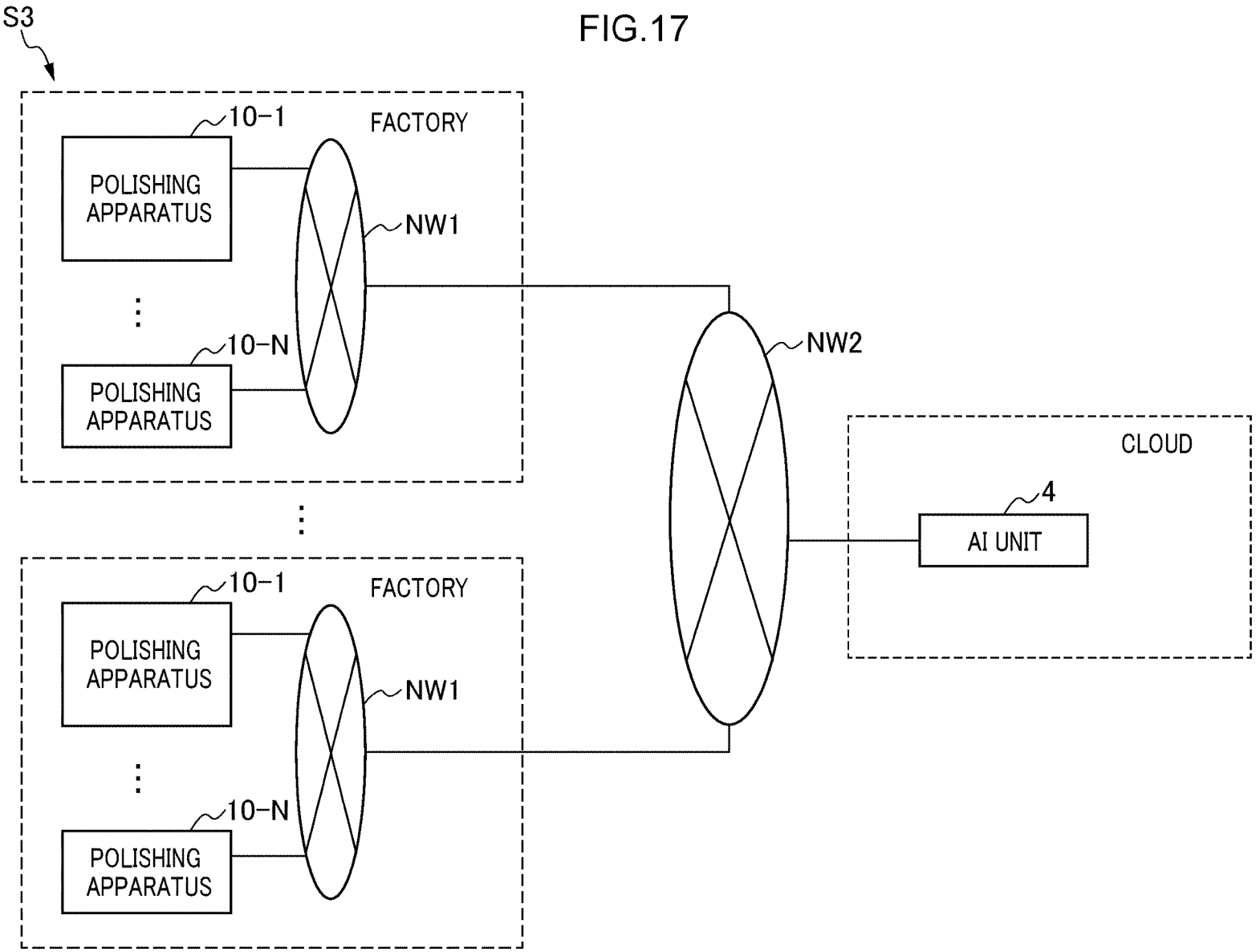
FIG. 17 is a schematic diagram showing an overall configuration of a polishing system according to a third embodiment.

FIG. 17 is a schematic diagram showing an overall configuration of a polishing system according to a third embodiment. As shown in FIG. 17, a polishing system S3 according to the third embodiment includes polishing apparatuses 10-1 to 10-N provided in a plurality of factories and the AI unit 4 provided in the cloud. The AI unit 4 can communicate with the polishing apparatuses 10-1 to 10-N via a global network NW2 and a local network NW1. The AI unit 4 is, for example, a computer (for example, server).

By providing the AI unit 4 in the cloud physically separated from the polishing apparatus as described above, it is possible to share the AI unit 4 among a plurality of factories, and the maintainability of the AI unit 4 is improved. Furthermore, by learning the machine learning model again with a large amount of data by using the data during polishing in a plurality of factories, it is possible to improve the estimation accuracy more quickly.

In addition, the machine learning model may be updated by collecting data (for example, large amount of data) of a plurality of polishing apparatuses over a plurality of factories. The data (for example, a large amount of data) of a plurality of polishing apparatuses over a plurality of factories may be collected and analyzed, and the analysis result may be applied in the polishing parameter setting.

The AI unit 4 may be provided in an analysis center that concentrates analysis, instead of the cloud.

The mounting location of the AI unit 4 may be (1) in the polishing apparatus, (2) a gateway near the polishing apparatus, and/or (3) a computer (PC, server, fog (computing), and the like) in a factory (for example, factory management room).

The mounting location of the AI unit 4 may be (1) in the polishing apparatus, (2) the gateway near the polishing apparatus, and/or (4) a computer in a cloud (or analysis center).

The mounting location of the AI unit 4 may be (1) in the polishing apparatus, (2) the gateway near the polishing apparatus, (3) the computer in the factory (for example, in the factory control room), and/or (4) the computer in the cloud (or analysis center).

In addition, the components of the AI unit 4 may be arranged to be distributed into (1) in the polishing apparatus, (2) the gateway near the polishing apparatus, (3) the computer (PC, server, fog (computing), and the like) in a factory (for example, factory management room), and/or (4) the computer in the cloud (or analysis center).

In the embodiments, the feature amount of the signal regarding the frictional force between the polishing member and the substrate in polishing is set to be input to the machine learning model, but the input is not limited this. The feature amount of the temperature of the polishing member (here, polishing pad 101) or the substrate in polishing may be input to the machine learning model. The reason is as follows. When the frictional force between the polishing member and the substrate during polishing increases, the amount of heat generated from the polishing member or the substrate increases by the increase of the frictional force, and the temperature of the polishing member or the substrate increases. Thus, the temperature of the polishing member or the substrate has a positive correlation with the frictional force between the polishing member and the substrate in polishing.

That is, the storage 41 may store the machine learning model learned using learning data in which the feature amount of the temperature of the polishing member or the substrate in polishing is input, and data regarding the film thickness of the polished substrate, the statistical value of the profile of the film thickness of the polished substrate, or the parameter related to the yield of a product included in the polished substrate is output.

In this case, the generation unit 451 may generate the feature amount from the signal regarding the frictional force between the polishing member and the substrate or the temperature of the polishing member or the substrate, during a period when the substrate is polished by pressing the target substrate against the polishing member while rotating the polishing head 1 having the target substrate attached thereto and the polishing table 100.

At least a part of the AI unit 4 described in the above-described embodiments may be configured by hardware or software. When a part of the AI unit 4 is configured by software, a program that realizes at least the part of the function of the AI unit 4 may be stored in a recording medium such as a flexible disk or a CD-ROM, and read and executed by a computer. The recording medium is not limited to a removable one such as a magnetic disk or an optical disk, and may be a fixed recording medium such as a hard disk device or a memory.

The program that realizes at least a part of the function of the AI unit 4 may be distributed via a communication line (including wireless communication) such as the Internet. Further, the identical program may be distributed via a wired line such as the Internet or a wireless line or may be stored and distributed in a recording medium, in a state of being encrypted, modulated, or compressed.

Further, one or a plurality of information processing devices may function as the AI unit 4. When a plurality of information processing devices are used, one of the information processing devices may be a computer, and the computer executes a predetermined program, and thereby the function as at least one means of the AI unit 4 may be realized.

In addition, in the invention of the method, all the processes (steps) may be realized by automatic control by a computer. The progress control between the processes may be manually performed while the computer is used to perform each process. Further, at least a part of the entire process may be performed manually.

Hitherto, the present technology is not limited to the above-described embodiments as they are, and can be embodied by modifying the components in a range without departing from the gist of the present technology at the implementation stage. In addition, various inventions can be formed by an appropriate combination of a plurality of components disclosed in the above-described embodiments. For example, some components may be removed from all the components shown in the embodiments. Furthermore, components over different embodiments may be combined as appropriate.

REFERENCE SIGNS

1 polishing head
100 polishing table
100*a* table shaft
101 polishing pad
101*a* polishing surface
102 table rotation motor
110 top ring head
111 top ring shaft
112 rotary cylinder
113 timing pulley
114 top-ring rotation motor
115 timing belt
116 timing pulley
117 top ring head shaft
124 up-down movement mechanism
126 bearing
128 bridge
129 support base
130 support column
132 ball screw
132*a* screw shaft
132*b* nut
138 servo motor
front load unit
21 FOUP
22 transport robot
26 rotary joint
3 retainer ring
4 AI unit
41 storage
42 memory
43 input unit
44 output unit
45 processor
451 generation unit
452 estimation unit
453 determination unit
5 cleaning unit
500 control unit
53 transport robot
6 film thickness measuring device
7 transporter
S1 to S3 polishing system

What is claimed is:

1. A polishing apparatus that is capable of referring to a storage in which a machine learning model is stored, the machine learning model being learned using learning data in which a feature amount of a signal regarding a frictional force between a polishing member and a substrate in polishing or a feature amount of a temperature of the polishing member or the substrate in polishing is input, and data regarding a film thickness of the polished substrate or a parameter related to yield of a product included in the polished substrate is output, the apparatus comprising:

a polishing table provided with the polishing member and configured to be rotatable;

a polishing head facing the polishing table and configured to be rotatable, wherein the substrate is attachable to a surface facing the polishing table;

a control unit configured to perform control to polish the substrate by pressing the substrate against the polishing member while rotating the polishing table and the polishing head having the substrate attached thereto;

a processor configured to generate the feature amount from the signal regarding the frictional force between the polishing member and the substrate in polishing or the feature amount from the temperature of the polishing member or a target substrate in polishing, and output the data regarding the film thickness of the polished substrate or any of the parameters related to the yield of the product included in the polished substrate, as an estimated value, by inputting the generated feature amount to the learned machine learning model; and a film thickness measuring device configured to measure the film thickness of the substrate, wherein the processor controls the film thickness measuring device to measure a film thickness of the polished target substrate when the output estimated value satisfies a predetermined polishing deterioration condition, and controls the film thickness measuring device not to measure the film thickness of the polished target substrate when the output estimated value does not satisfy the predetermined polishing deterioration condition.

2. The polishing apparatus according to claim 1, wherein the processor stops processing for a subsequent substrate when the output estimated value satisfies a predetermined polishing deterioration condition.

3. The polishing apparatus according to claim 1, wherein the processor outputs a maintenance timing by using a tendency of the estimated value output for the polished substrate at a plurality of different times.

4. The polishing apparatus according to claim 1, wherein the processor performs control to issue a warning for urging a maintenance, when the output estimated value satisfies a predetermined polishing deterioration condition.

5. The polishing apparatus according to claim 1, wherein the processor adjusts a polishing condition for a subsequent substrate in accordance with the output estimated value so that data regarding a desired film thickness of a polished substrate or a parameter related to desired yield of a product included in the polished substrate is obtained.

6. The polishing apparatus according to claim 1, wherein the processor learns the machine learning model again using the feature amount during an operation of the polishing apparatus.

7. A polishing method for polishing a substrate by a polishing apparatus that is capable of referring to a storage in which a machine learning model is stored, the machine learning model being learned using learning data in which a feature amount of a signal regarding a frictional force between a polishing member and a substrate in polishing or a feature amount of a temperature of the polishing member or the substrate in polishing is input, and data regarding a film thickness of the polished substrate or a parameter related to yield of a product included in the polished substrate is output, the method comprising:

polishing the substrate by pressing the substrate against the polishing member while rotating the polishing table and the polishing head having the substrate attached thereto;

generating the feature amount by measuring the signal regarding the frictional force between the polishing member and the substrate in polishing or the temperature of the polishing member or a target substrate in polishing;

inputting the generated feature amount to the learned machine learning model;

outputting the data regarding the film thickness of the polished substrate or any of the parameters related to the yield of the product included in the polished substrate, as an estimated value; and determining whether or not the output estimated value satisfies a predetermined polishing deterioration condition; and causing a film thickness measuring device to measure a film thickness of the polished target substrate when the output estimated value satisfies the predetermined polishing deterioration condition, and not to measure the film thickness of the polished target substrate when the output estimated value does not satisfy the predetermined polishing deterioration condition.

8. The polishing method according to claim 7, further comprising:

determining whether or not the output estimated value satisfies a predetermined polishing deterioration condition; and stopping processing for a subsequent substrate when the output estimated value satisfies the predetermined polishing deterioration condition.

9. The polishing method according to claim 7, further comprising outputting a maintenance timing by using a tendency of the estimated value output for the polished substrate at a plurality of different times.

10. The polishing method according to claim 7, further comprising:

determining whether or not the output estimated value satisfies a predetermined polishing deterioration condition; and issuing a warning for urging a maintenance when the output estimated value satisfies the predetermined polishing deterioration condition.

11. The polishing method according to claim 7, further comprising adjusting a polishing condition for a subsequent substrate in accordance with the output estimated value so that data regarding a desired film thickness of a polished substrate or a parameter related to desired yield of a product included in the polished substrate is obtained.

12. The polishing method according to claim 7, further comprising learning the machine learning model again using the feature amount during an operation of the polishing apparatus.

* * * * *